US005483726A

United States Patent [19]

Blase et al.

[11] Patent Number: 5,483,726

[45] Date of Patent: Jan. 16, 1996

[54] COMBINATION VACUUM CLEANER AND WATER EXTRACTOR POWER FOOT

[75] Inventors: Michael Blase; Luke E. Kelly; Steven K. Meek; Brenda K. Langeland, all of Grand Rapids; Richard L. Norwood, Rockford, all of Mich.

[73] Assignee: Bissell Inc., Grand Rapids, Mich.

[21] Appl. No.: 181,701

[22] Filed: Jan. 14, 1994

Related U.S. Application Data

[63] Continuation-in-part of Ser. No. 273, Jan. 4, 1993, Pat. No. 5,398,373.

[51] Int. Cl.[6] ..... A47L 9/04

[52] U.S. Cl. ..... 15/321; 15/322; 15/331

[58] Field of Search ..... 15/321, 331, 334, 15/335, 322

[56] References Cited

U.S. PATENT DOCUMENTS

| | | | |
|---|---|---|---|
| D. 289,336 | 4/1987 | Fitzwater . | |
| 742,880 | 11/1903 | Lotz . | |
| 965,315 | 7/1910 | Moorhead . | |
| 1,217,817 | 2/1917 | Peters | 15/335 |
| 2,293,722 | 8/1942 | Erickson . | |
| 2,909,800 | 10/1959 | Grindle et al. | 15/321 |
| 3,747,155 | 7/1973 | Koellisch | 15/321 X |
| 3,780,397 | 12/1973 | Harbeck et al. . | |
| 3,815,172 | 6/1974 | Fromknect et al. . | |
| 3,892,255 | 7/1975 | Johnson . | |
| 3,908,223 | 9/1975 | Brooks et al. . | |
| 3,942,216 | 3/1976 | Minton | 15/331 |
| 3,974,541 | 8/1976 | Silvis et al. . | |
| 4,019,531 | 4/1977 | Johnson . | |
| 4,069,541 | 1/1978 | Williams et al. . | |
| 4,139,922 | 2/1979 | Fitch . | |
| 4,167,799 | 9/1979 | Webb . | |
| 4,167,801 | 9/1979 | Erbor et al. . | |
| 4,194,262 | 3/1980 | Finley et al. . | |
| 4,287,635 | 9/1981 | Jacobs | 15/321 |
| 4,314,385 | 2/1982 | Wimsatt et al. | 15/321 |
| 4,334,336 | 6/1982 | Harbeck et al. . | |
| 4,385,413 | 5/1983 | Goldsmith . | |
| 4,407,041 | 10/1983 | Goldsmith . | |
| 4,408,366 | 10/1983 | Goldsmith . | |
| 4,447,930 | 5/1984 | Glenn, III et al. . | |
| 4,457,042 | 7/1984 | Jones et al. . | |
| 4,485,518 | 12/1984 | Kasper . | |
| 4,488,329 | 12/1984 | Lackenbach . | |
| 4,488,330 | 12/1984 | Grave . | |
| 4,498,214 | 2/1985 | Oxel . | |
| 4,512,057 | 4/1985 | Laing et al. . | |
| 4,521,935 | 6/1985 | Johnston et al. . | |
| 4,521,936 | 6/1985 | Medwed | 15/377 |
| 4,537,424 | 8/1985 | Maier et al. | 15/377 |
| 4,542,556 | 9/1985 | Hepple . | |
| 4,549,328 | 10/1985 | Martin et al. . | |
| 4,559,665 | 12/1985 | Fitzwater . | |
| 4,610,047 | 9/1986 | Dick et al. . | |
| 4,615,068 | 10/1986 | Martin et al. . | |
| 4,654,925 | 4/1987 | Grave . | |
| 4,696,074 | 9/1987 | Cavalli . | |

(List continued on next page.)

FOREIGN PATENT DOCUMENTS

WO88/08269 11/1988 United Kingdom .

*Primary Examiner*—Chris K. Moore
*Attorney, Agent, or Firm*—Varnum, Riddering, Schmidt & Howlett

[57] ABSTRACT

A multi-use power foot suitable for use for both dry vacuum cleaning and water extraction procedures is disclosed. The power foot has a dry suction chamber in fluid communication with an outlet and a water suction chamber in fluid communication with the outlet. A diverter valve member is mounted within the housing to selectively restrict the air flow from one of the chambers to the outlet. A rotating brush is mounted in the opening of the dry suction chamber to agitate the surface to be cleaned in both the dry vacuum cleaning and water extraction modes. Spray nozzles are mounted to the underside of the power foot to direct a water based cleaning solution to the surface to be cleaned.

12 Claims, 19 Drawing Sheets

U.S. PATENT DOCUMENTS 4,887,330 12/1989 Woodhall et al. .
4,888,851 12/1989 Crouser et al. .
4,951,346 8/1990 Salmon .
5,063,634 11/1991 Häfele et al. ..... 15/377
5,101,534 4/1992 Watanabe et al. .
5,105,503 4/1992 Holland .
5,127,128 7/1992 Lee .
5,168,598 12/1992 Hashizume et al. .
5,168,599 12/1992 Williams .
5,189,757 3/1993 Williams et al. .
5,210,902 5/1993 Lee et al. .

COMBINATION VACUUM CLEANER AND WATER EXTRACTOR POWER FOOT

This is a continuation-in-part of U.S. patent application Ser. No. 08/000,273 filed Jan. 4, 1993, now U.S. Pat. No. 5,398,373, issued Mar. 27, 1995.

BACKGROUND OF THE INVENTION

1. Field of the Invention

This invention relates to vacuum cleaning machines and water extractor machines, and more particularly, to a power foot suitable for attachment to a machine which functions as a vacuum cleaner and a water extractor machine.

2. Description of Related Art

Consumers have long cleaned their carpets, rugs and floors with vacuum cleaner machines. These machines apply suction to the surface to be cleaned to remove dirt and dust particles, a process commonly called dry vacuuming. Vacuum cleaners usually include a suction foot or wand for overlying the carpet or other surface to be cleaned. The suction foot distributes the suction supplied by the vacuum cleaner over a broad area through the use of a nozzle mounted in the foot. A rotating brush or beater bar is typically mounted in the housing to aid in the removal of dirt and dust from the surface being vacuumed. Experience has shown that the incorporation of a rotating brush on a vacuum cleaner greatly enhances the cleaning performance of the vacuum cleaner.

An alternative to dry vacuuming is the use of a water extractor or deep cleaning machine. These machines apply water or a cleaning fluid solution to the surface of the carpet or floor to be cleaned and remove this solution by applying suction. Water extractors are often more effective in removing dirt and dust from a carpet surface than dry vacuuming. Similar to the vacuum cleaner, agitation means, such as a rotating brush, greatly increases the cleaning performance of the water extractor machine. Examples of water extractor machines incorporating agitation devices are disclosed in U.S. Pat. No. 4,488,329 to Lackenbach, issued Dec. 18, 1984, U.S. Pat. No. 4,887,330 to Woodhall et al. issued Dec. 19, 1989 and U.S. Pat. No. 4,069,541 to Williams et al. issued Jan. 24, 1978.

Manufacturers of vacuum cleaning machines and water extractors are now developing multi-use machines which can be used for dry vacuuming and some form of enhanced cleaning operation. For example, U.S. Pat. No. 4,951,346 issued Aug. 28, 1990 to Salmon and U.S. Pat. No. 2,293,722 issued Aug. 25, 1942 to Erickson, disclose a combination vacuum cleaner machine and rug shampoo machine; U.S. Pat. No. 4,498,214 issued Feb. 12, 1985 to Oxel, discloses a combination vacuum cleaner machine and dry or liquid cleaning agent machine; and U.S. Pat. No. 4,549,328 issued Oct. 24, 1985 to Martin et al., discloses a convertible vacuum cleaner and powder carpet cleaner machine.

SUMMARY OF INVENTION

According to the invention, a vacuum cleaner has an agitation member for use in both dry vacuuming and vacuum water extraction and a switch for convenient conversion from dry vacuum to vacuum water extraction. This provides superior cleaning results of the carpet, rug or hard floor surface over the known prior art machines.

According to the invention, a combination vacuum cleaner and water extractor foot for cleaning a surface comprises a housing having a front edge, a rear edge opposite the front edge and a bottom surface extending between the front and rear edges. A first suction opening is formed in the housing bottom surface. A second suction opening is formed in the housing bottom surface a spaced distance rearwardly of the first suction opening. An outlet suction conduit is connected to the housing and adapted to be connected to a vacuum source. A connecting conduit is between the first and second suction openings and the outlet suction conduit. A diverter valve comprising a partially cylindrical body is rotatably mounted in the conducting conduit for selectively connecting one of the first and second suction openings and the outlet suction conduit while at the same time selectively occupying a portion of the connecting conduit thereby at least partially blocking suction communication between the other of the first and second suction openings and the outlet suction conduit, and visa versa.

Preferably, the first suction opening is an elongated slit for removing liquid solution from a carpet and is near the front edge of the housing. Spray nozzles are preferably mounted in the housing for distributing cleaning fluid to the surface to be cleaned. The spray nozzles are desirably mounted in a recess in a bottom surface of the housing. In a preferred embodiment of the invention, an agitator is mounted in the housing adjacent the spray nozzles and is adapted to agitate a carpet or hard floor surface beneath the bottom surface of the housing. The agitator is preferably a bristle containing member, such as a brush or a beater bar, which is rotatably mounted in the housing and driven by an electric motor. Preferably, the second suction opening communicates with the agitator.

In a preferred embodiment of the invention, the outlet suction conduit is pivotably mounted to the housing. Further, the housing mounts forward and rear wheels, front and rear portions, respectively, and the outlet suction conduit is mounted to the housing between the forward and rear wheels so that an operator can apply downward force to the housing by applying downward force to the outlet conduit. In this manner, carpets can be scrubbed with the extractor foot to remove stains from carpeting and allows the first suction opening to be pressed deeper into the carpet resulting in deeper cleaning of the carpet.

The diverter valve preferably comprises a valve member which is rotatably mounted within the housing for movement between first and second positions. A switch is preferably mounted to an exterior surface of the housing for access by a user and connected to the diverter valve for controlling the movement of the diverter valve within the housing between the first and second positions, the movement of the switch being substantially along a longitudinal axis of the housing, the axis extending between the front and rear edges of the housing.

In one embodiment, an actuator interconnects the diverter valve control switch and the diverter valve. The actuator is adapted to convert the longitudinal movement of the diverter valve control switch into rotational movement of the diverter valve from a first position blocking the suction communication between the second suction opening and the vacuum source, and a second position at least partially blocking the suction communication between the first suction opening and the vacuum source. In the preferred embodiment, the partially cylindrical body of the diverter valve rotates about an arc of less than 120° when moved from a position of blocking the suction communication between one of the first second suction openings and the other of the first second suction openings.

In a further preferred embodiment of the invention, the motor is a two-speed motor and an electrical switch is provided for controlling the speed of the motor. Preferably, the electrical switch is connected to the diverter valve control switch to switch the motor between the first and second speeds when the diverter valve switch is between the first and second positions which correspond to connecting the outlet conduit to the first and second openings, respectively, and an on/off position, intermediate the first and second positions.

BRIEF DESCRIPTION OF THE DRAWINGS

The invention will now be described with reference to the drawings wherein.

DESCRIPTION OF THE PREFERRED EMBODIMENTS

Figure 1:
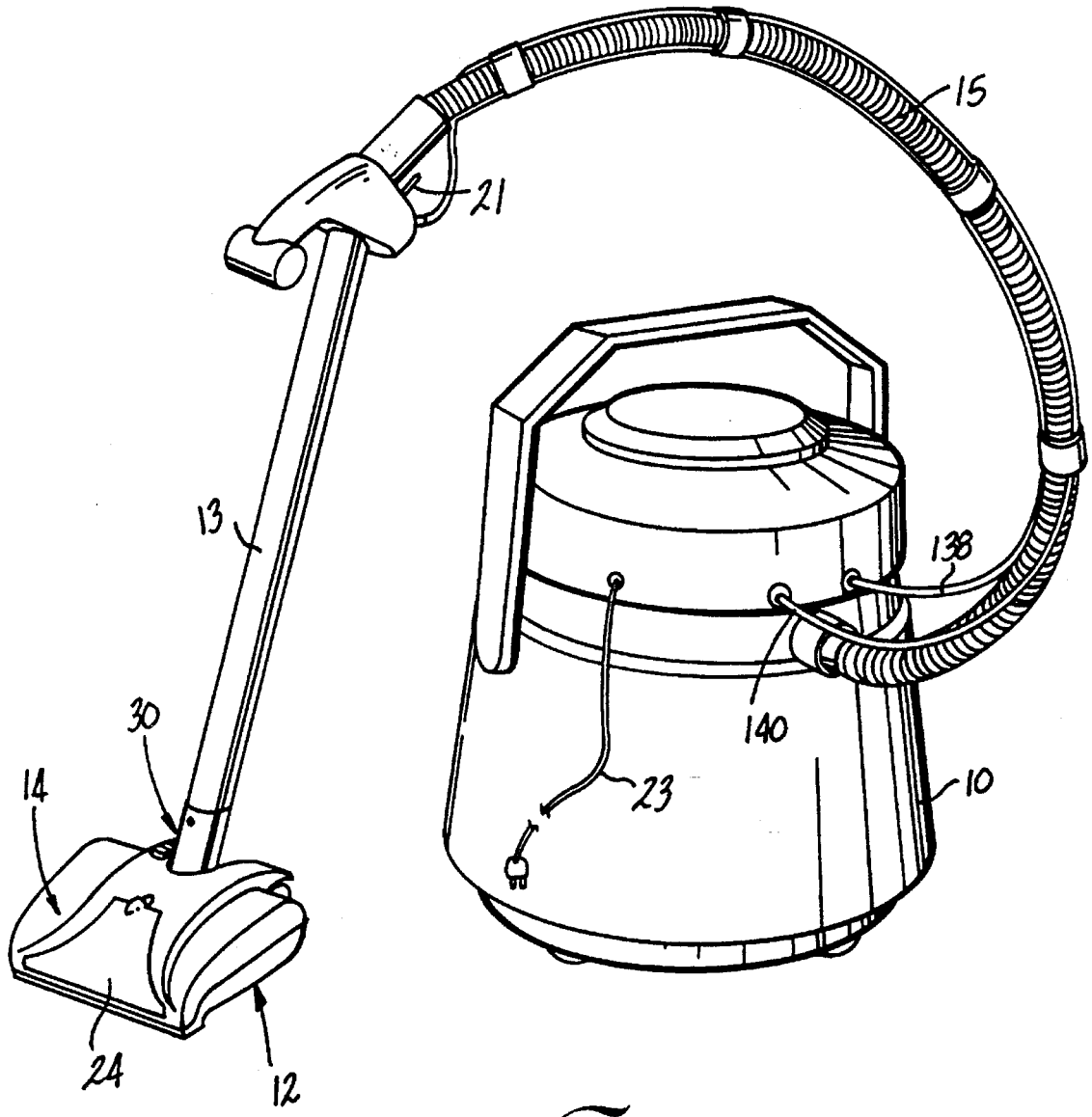
FIG. 1 is a perspective view of a multi-use water extraction and dry vacuum machine with a multi-use power foot according to the invention mounted thereto.

Referring now to the drawings and to FIG. 1 in particular, there is shown a multi-use water extractor and dry vacuum machine 10, a multi-use power foot 12 according to the invention, and a wand 13 and hose 15 interconnecting the power foot 12 to the multi-use machine 10. The multi-use machine 10 houses a conventional vacuum motor, a water and cleaning solution reservoir, a pump to pressurize the cleaning solution and a repository for dirt, dust and water collected by the power foot 12. The suction created by the multi-use machine 10 is communicated to the power foot 12 through the hose 15 and wand 13. Electrical power is supplied to the multi-use machine 10 from a conventional outlet through the electrical cord 23. Electrical power is conveyed from the multi-use machine to the power foot 12 through the electrical cord 138. Similarly, the water cleaning solution is supplied from the multi-use machine 10 to the power foot 12 through a fluid conduit 140 by the conventional pump. The flow of water cleaning fluid solution through the fluid conduit 140 is controlled by a conventional trigger 21. The multi-use machine 10 and power foot 12 according to the invention can be used for both water extraction and dry vacuuming purposes for rugs, carpet and hard floor surfaces.

An example of a multi-use machine which can be easily adapted for use with the power foot 12 according to the invention is disclosed in U.S. patent application Ser. No. 757,249 filed Sep. 10, 1991, now U.S. Pat. No. 5,287,587, issued Feb. 22, 1994. Another suitable machine is currently being marketed by Bissell, Inc. of Grand Rapids, Mich. under the trademark THE BIG GREEN CLEAN MACHINE.™ Both of the machines described above need only be modified to provide a source of electrical power to the power foot 12. The source of power could be directly from a conventional outlet or routed through the housing of the machine as shown in FIG. 1.

As seen in FIGS. 2, 3, 5 and 6, the combination vacuum cleaner and water extractor power foot 12 comprises a housing 14 formed by a rectangular upper housing member 16 and a rectangular lower housing member 18. The rectangular upper housing member 16 has a curving upper surface from a front edge 17 to a rear edge 19. The sides of the rectangular upper housing member 16 are defined by depending side portions 29. A raised central channel 20 is formed in a central portion of the upper housing member 16 and extends from the front edge 17 to beyond the rear edge 19. The central channel 20 has a truncated triangular shaped opening 22 with a similarly shaped lens 24 mounted therein. An open raised projection 25 is formed at an upper portion of the lens 24 in registry with a depression 26 formed in the raised central channel 20. A U-shaped recess 28 is formed at a rear portion of the raised central channel 20. A tubular outlet 30 is mounted within the U-shaped recess 28 for movement between a vertical position shown in FIGS. 2, 3, 5 and 6 and a reclining position shown in FIGS. 10 and 12. The outlet tube 30 has a suction conduit 38 and a rear conduit 40 both of which define side recessed channels 44 and 46.

A diverter valve switch 32 is mounted on a rear portion of the raised central channel 20 for reciprocatory movement in a front-to-back direction. Rear wheels 34 are rotatably mounted to depending walls 36 which extend rearwardly from the rear edge 19 and downwardly from the extension of the raised central channel 20.

Figure 3:
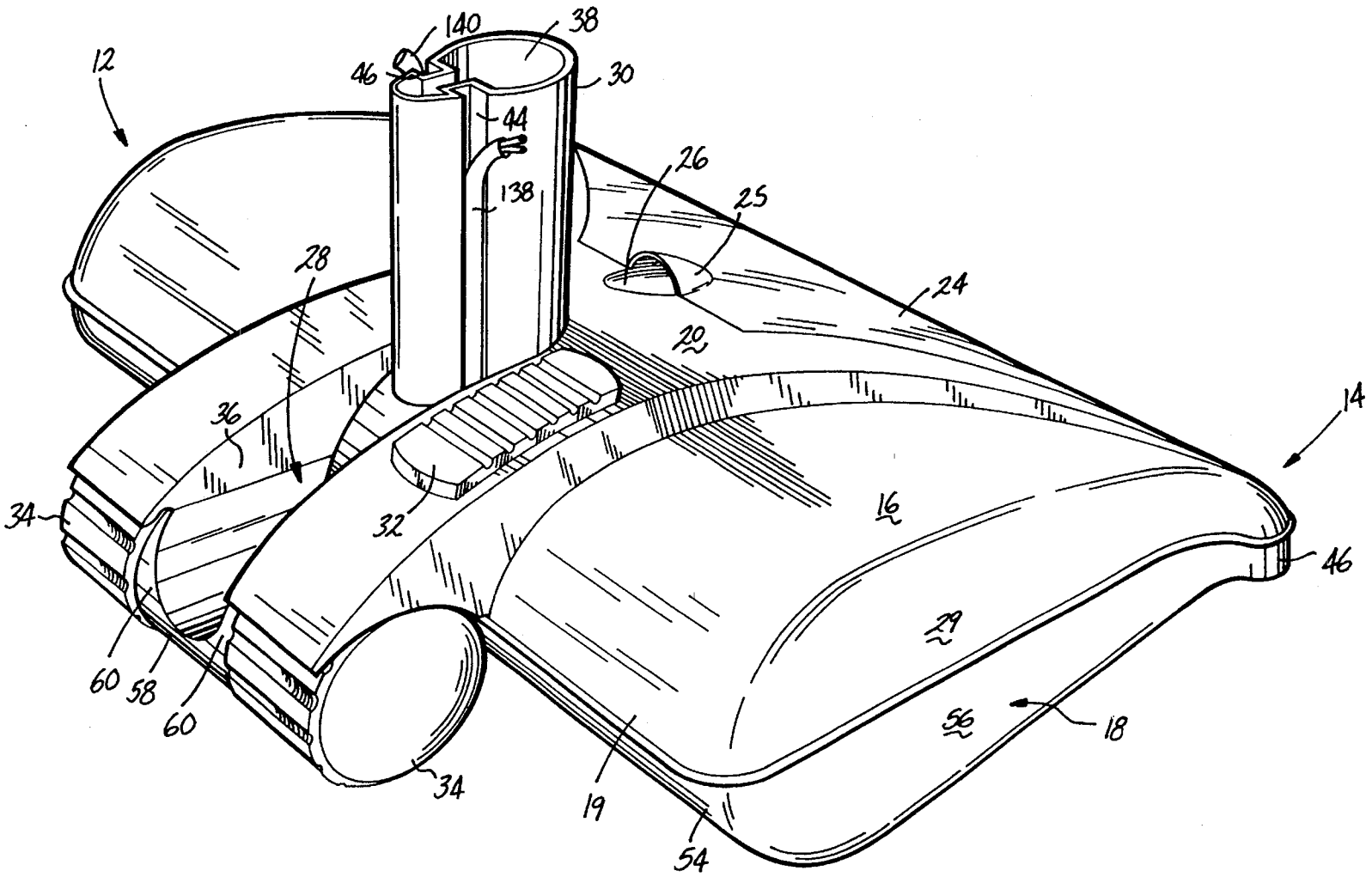
FIG. 3 is a rear perspective view of the multi-use power foot shown in FIG. 2.

The lower housing member 18, as seen in FIG. 3, has a bottom wall 50, a front wall 52, a back wall 54 and side walls 56. A bumper 46 is mounted to the front wall 52 of the lower housing member 18. The bumper 46 is preferably made of a soft elastic material and mounted such that it extends around the front wall to the side walls 56. The back wall 54 has a rearward extension 58 which defines a pair of upwardly extending wall portions 60. An elongated wet vacuum opening 62 is formed in a front of the lower housing member 18. Front wheels 64 having axles (not shown) are rotatably mounted in the lower housing member 18 in a conventional manner. A brush opening 66 is provided rearwardly of the wet vacuum opening 62. An elongated spray opening 68 is provided rearwardly of the brush opening 66.

Figure 8:
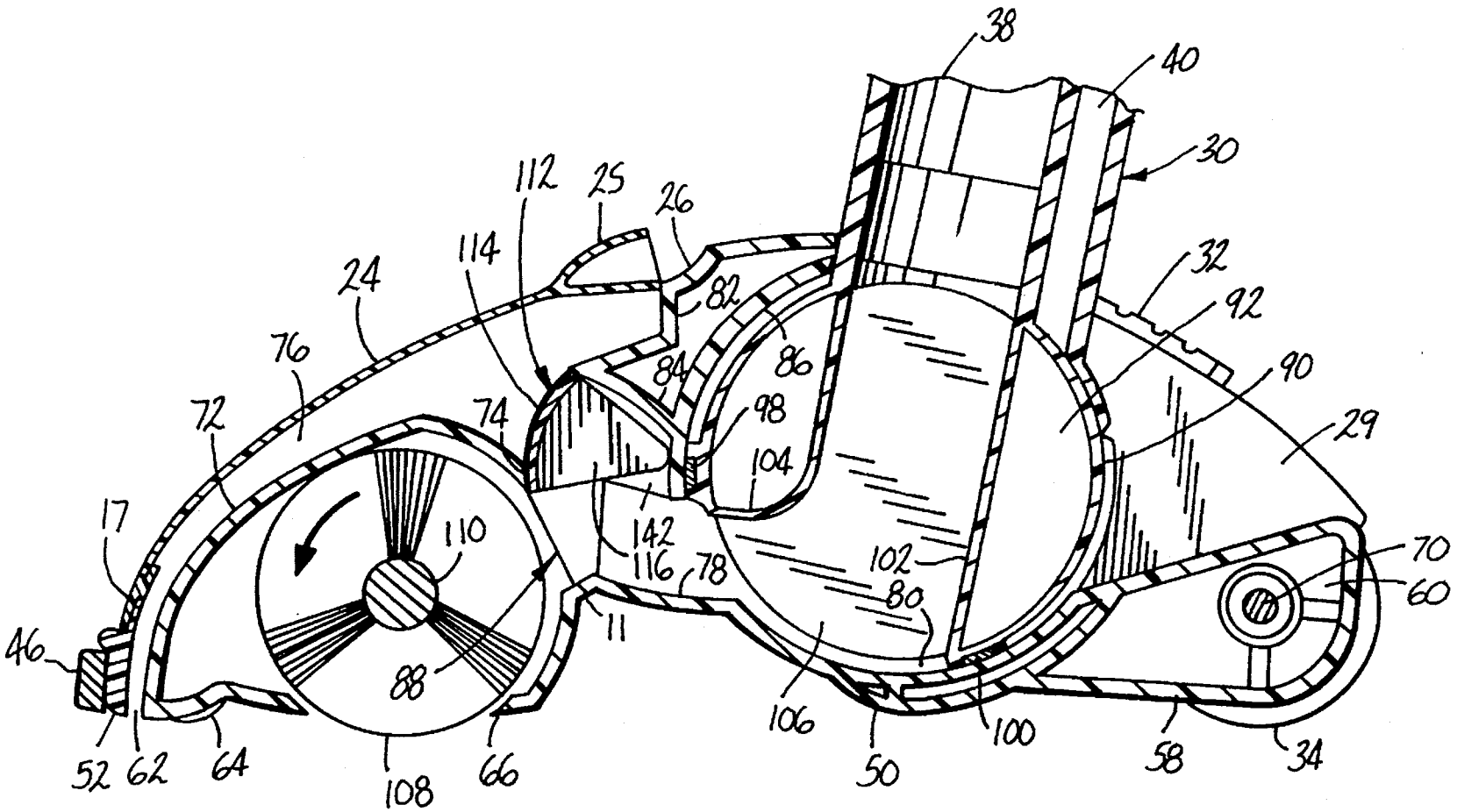
FIG. 8 is a sectional view of the power foot taken along lines 8—8 of FIG. 6 showing a diverter valve member in the dry vacuum position and an outlet tube in a vertical position.

Referring now to FIG. 8, the rear portion of the rearward extension 58 is shown in section to show the mounting of the rear wheel 34 to the upwardly extending wall portion 60. To this end, the wheel 34 has an axle 70 which is journaled in a circular opening in the outer wall of the wall portion 60. Preferably, the wheel 34 and axle 70 are integrally molded and adapted to be rotatively mounted in a corresponding recess.

As shown more clearly in FIG. 8, the lower housing member 18 has a front internal wall 72 extending upwardly from the wet vacuum opening slot 62 and extends rearwardly thereof, terminating in an edge 74 to define with the lens 24 a water suction channel 76. The lower housing member 18 further has a central internal wall 78 extending upwardly from the rear edge of the brush opening 66 and then rearwardly, terminating in an arcuate portion 80. The upper housing member 16 has a central depending wall 82 which joins a downwardly and rearwardly extending transition wall portion 84. Arcuate wall 86 joins the bottom of the transition wall portion 84 and forms with the arcuate wall portion 80 of the lower housing member 18 a cylindrical chamber. A conventional brush 108 having a central axle 110 is rotatably mounted in the lower housing member 18 for rotational motion in a conventional fashion. Typically, the brush rotates in a counterclockwise direction as seen in FIG. 8.

The tubular outlet 30 has a cylindrical lower end 90 with end walls 92 (only one of which is shown in FIG. 8). A pair of sealing members 98, 100 are mounted to the outer portion of the cylindrical lower end 90 of the tubular outlet 30 in sealing engagement with the arcuate wall 86 and the arcuate wall portion 80, respectively. The sealing members 98, 100 seal the cylindrical lower end 90 to the upper housing member 16 and the lower housing member 18 at the opening formed by the arcuate wall 86 at the upper end and the arcuate wall 80 at the lower end. (See also FIGS. 15 and 16.) A cylindrical lower end 90 further includes a tubular suction channel 102 which communicates with the suction conduit 38 and has a laterally extending lower portion 104 which forms a wide mouth opening 106 in communication with a dry suction opening 88 and the water suction channel 76.

Figure 2:
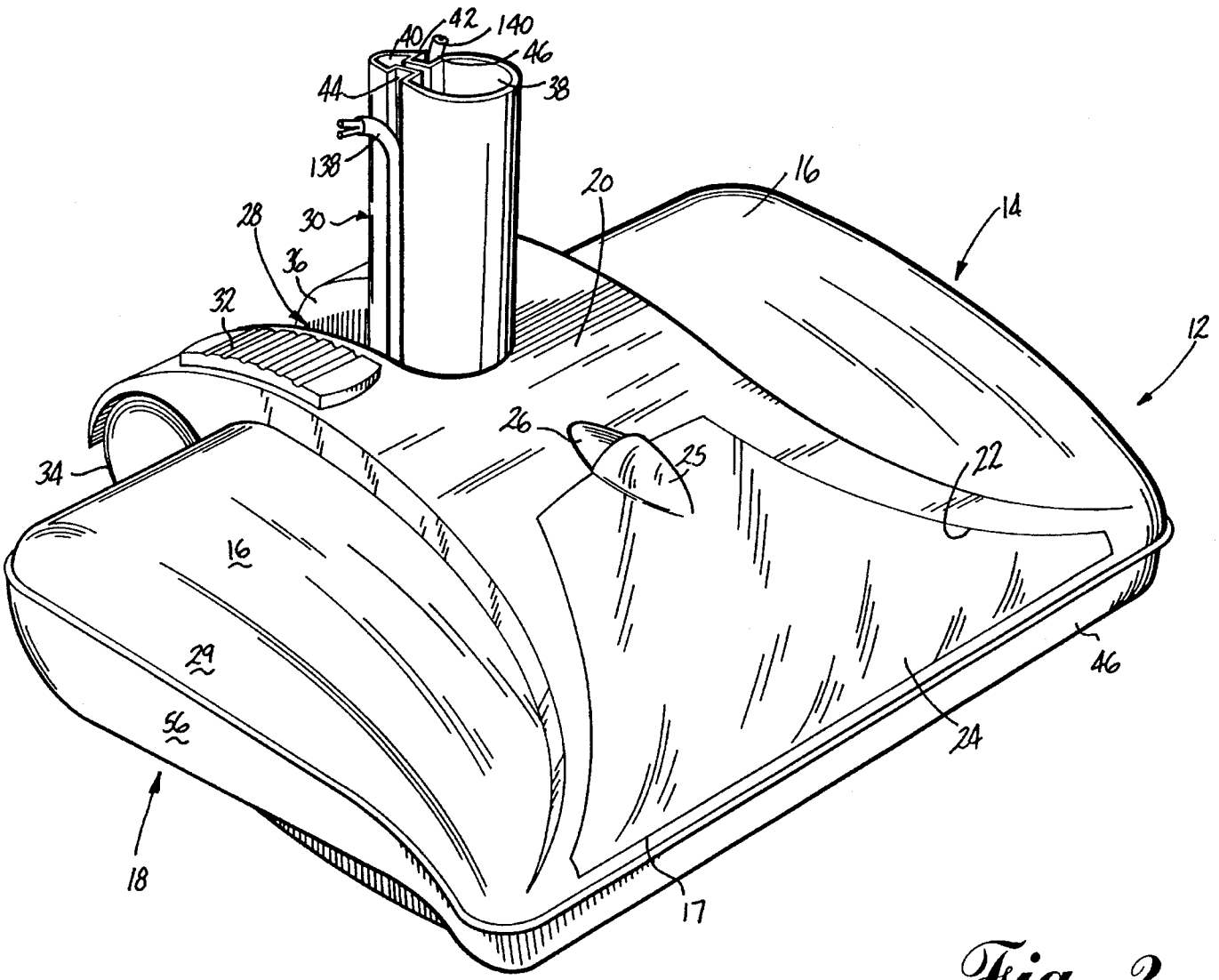
FIG. 2 is a front perspective view of the multi-use power foot according to the invention.

The tubular outlet 30 is pivotally mounted in the housing 14 for movement between a vertical position and a reclining position. The tubular outlet 30 is adapted to receive one end of the wand 13 from the multi-use machine 10. The multi-use machine 10 can be any machine which has a tank to supply cleaning fluid, a vacuum source to draw the water from the carpet and a vacuum source for drawing dust or dirt-laden air from the brush area of the power foot and means to supply cleaning solution and electrical current to the power foot 12. As seen in FIGS. 1–3, an electrical cord 138 is threaded along the channel 44 and a fluid conduit 140 is threaded along the channel 46.

Figure 7:
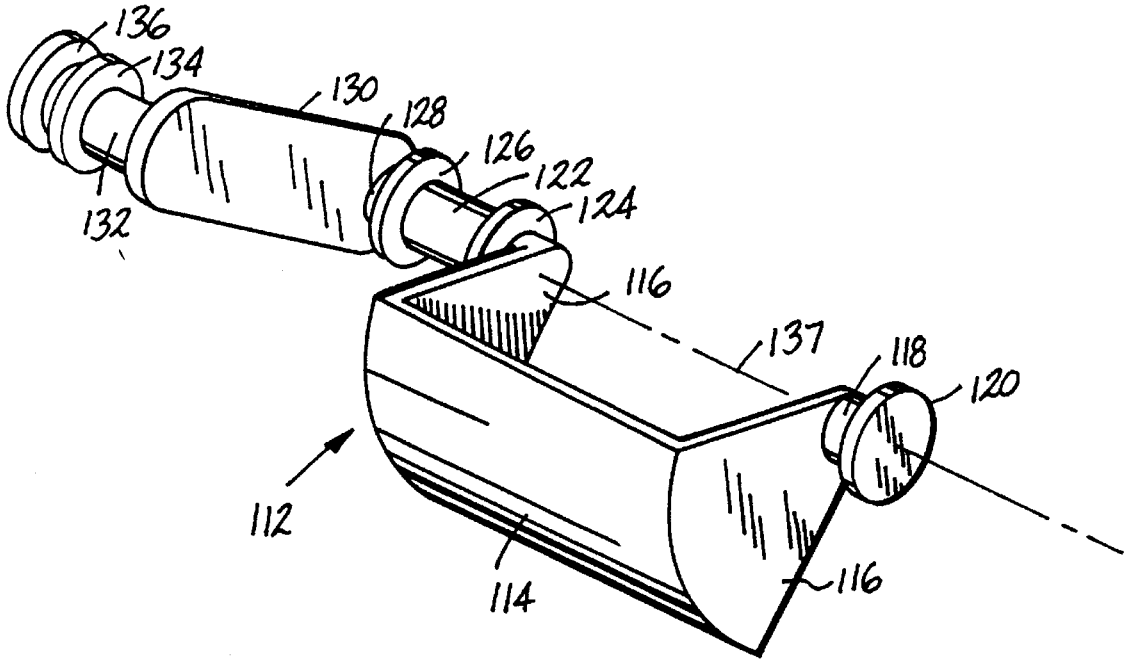
FIG. 7 is a perspective view of the diverter valve member for use in the power foot according to the invention.
Figure 12:
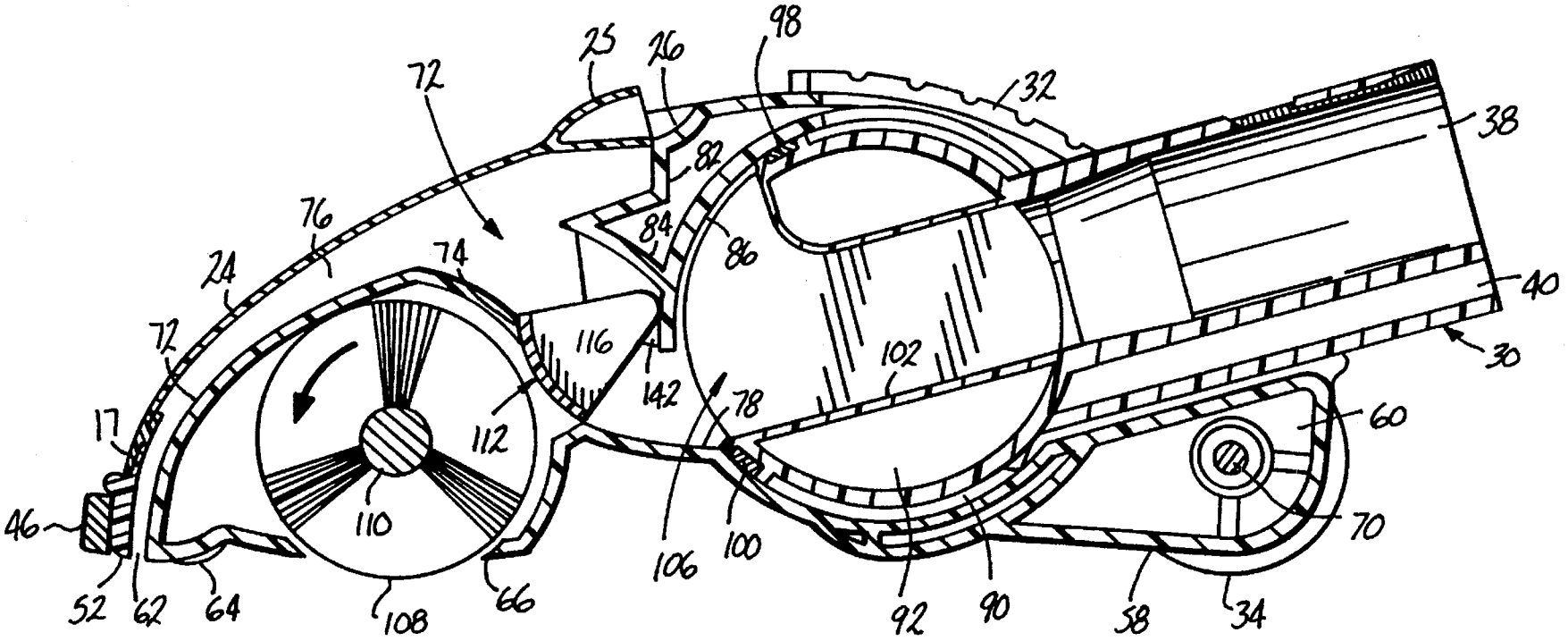
FIG. 12 is a sectional view of the power foot like FIG. 10 but showing the diverter valve in the water extraction position.

Referring now to FIGS. 7 and 8, a diverter valve 112 has an arcuate wall 114 and side walls 116. A bearing 118 extends outwardly from one end of one of the side walls 116 and terminates in an end flange 120. A bearing 122 extends from the other side wall 116 and is bounded by circular washers 124 and 126. A shaft 128 rigidly connects a linking arm 130 with the bearing 122. Another end of the linking arm 130 is connected to a shaft 132 having positioning washers 134 and 136. In operation, the diverter valve 112 is mounted for rotation about an axis of rotation 137 through the bearings 118 and 122. The linking arm 130 is rigidly connected to the bearing 122 and thus rotates angularly about the axis of rotation 137 with the arcuate side walls 116. As seen in FIG. 8, in one position, the diverter valve 112 closes the opening between the water suction channel 76 and the tubular suction channel 102. Rotation of the diverter valve 112 in a counterclockwise direction as viewed in FIG. 8 opens up communication between the water suction channel 76 and the tubular suction channel 102. The full extent of rotation is illustrated in FIG. 12 wherein the diverter valve 112 closes off the opening between the brush opening 66 and the tubular suction channel 102. The arc of rotation of the diverter valve 112 is preferably less than 120° . The shorter the arc of rotation, the more compact the diverter valve mechanism. The arc of rotation of the embodiment depicted in FIGS. 7 and 8 rotates about an arc of approximately 70° .

The diverter valve 112 is mounted within the upper housing member 16 through depending side wall portions 142 (only one of which is shown in FIGS. 8 and 12). To this end, slots are provided in the side wall portions 142 to receive the bearings 118 and 122. The lateral position of the diverter valve between the walls is limited by the end flange 120 and by the circular washers 124 and 126.

Preferably, the brush 108 is mounted in the dry vacuum nozzle of the housing 14 such that the bristles of the brush extend downwardly through the opening of the dry vacuum nozzle to penetrate the carpet pile and to agitate the carpet fibers or to scrub the surface of the hard floor. The agitation provided by the brush enhances the cleaning performance of a multi-use machine in both the dry vacuum and the water extraction modes.

Figure 9:
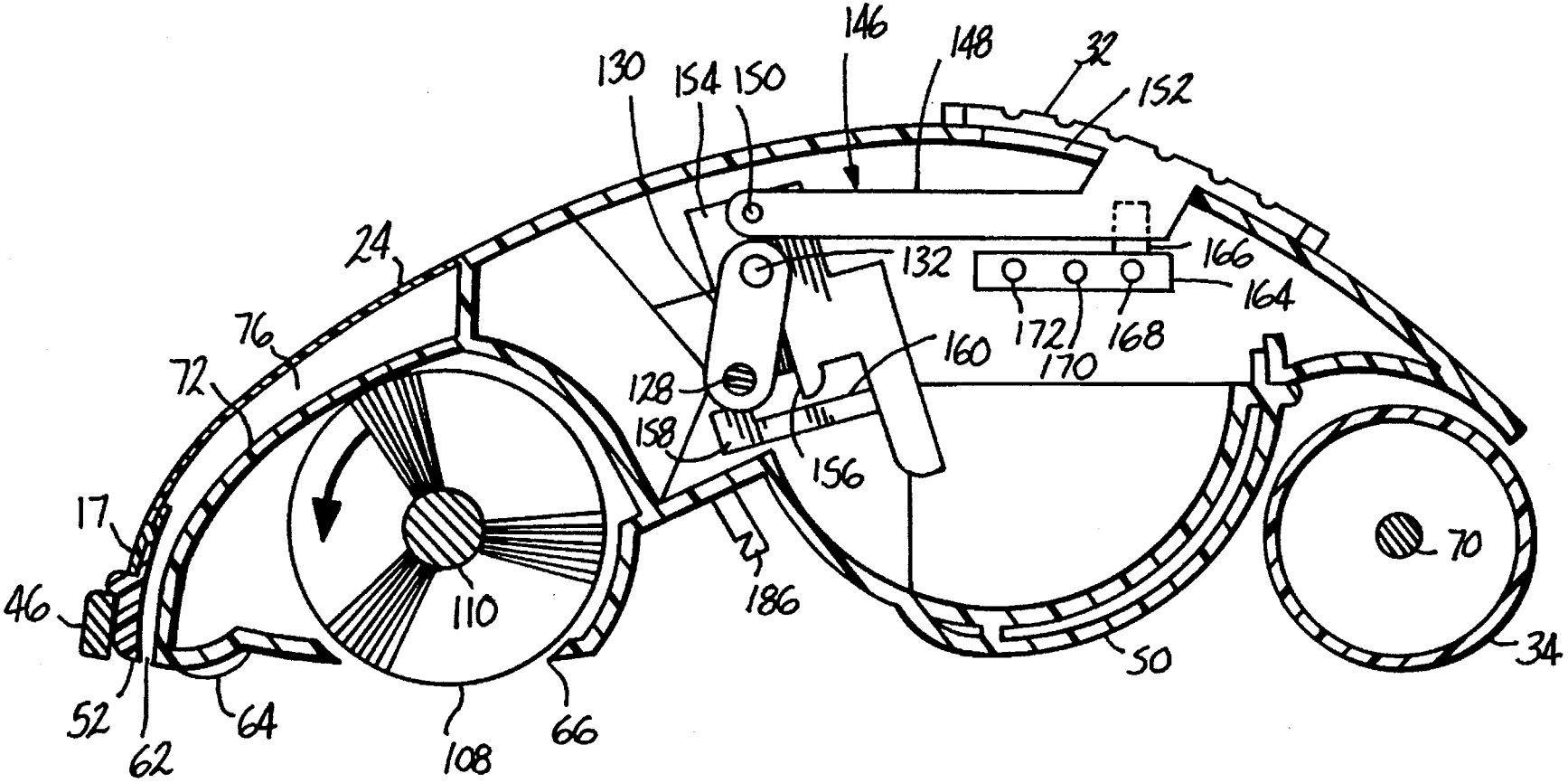
FIG. 9 is a sectional view of the power foot taken along lines 9—9 of FIG. 6 showing the actuator and switch in the dry vacuum position.

As seen in FIGS. 7–9, the diverter valve 112 is connected to a valve actuator 146 which is in turn connected to the diverter valve switch 32. Through manipulation of the diverter valve switch 32, the user can switch the power foot 12 from the off position to the dry vacuum mode, or to the water extraction mode.

As seen in FIG. 9, the valve actuator 146 comprises an actuator arm 148 which is mounted to the diverter valve switch 32. A first end of the actuator arm 48 extends through an opening 152 formed on the top surface of the raised central channel 20 and is mounted to the underside of the diverter valve switch 32. The second end of the actuator arm 148 is pivotally connected to a sliding member 154 through pin 150. The sliding member has a slot 56 which receives the shaft 132 between the washers 134, 136. The sliding member 154 is mounted for limited fore and aft sliding reciprocation in a guide wall 158 of the upper housing member 16.

To this end, the guide wall 158 has a later slot which receives a shaft bearing (not shown) mounted to the sliding member 154 for guiding the fore and aft movement of the sliding member 154. In this manner, the diverter valve switch 32, the valve actuator 146 and the diverter valve member 112 are interconnected.

A three position electrical switch 164 is mounted in the upper housing member 16 adjacent to the actuator arm 148. The electrical switch 164 is mechanically interconnected to the actuator arm 148 by an upwardly extending switch arm 166. The arm 166 slides within the three position electrical switch 164 as the diverter valve switch 32 is moved to and from the water extraction, dry vacuum and off positions.

The three position electrical switch 164 comprises three pairs of electrical contacts 168, 170 and 172 corresponding to the dry vacuum mode, the off position and the water extraction mode, respectively. The first and third electrical contacts 168 and 172 are electrically connected to a brush motor 174. The switch arm 166 has an electrical conductor which connects the pairs of electrical contacts 168 and 172 to complete the electrical circuit to the motor. The circuit which includes the electrical contacts 172 contain a step down circuit to reduce the motor speed. Preferably, the brush motor 174 is a two-speed motor capable of rotating the brush 108 at a first speed of approximately 4,000 rpm for the dry vacuum mode and a second speed of approximately 2,000 rpm for the water extraction mode. A slower speed of rotation is necessary for the water extraction mode to prevent excess agitation of the water and cleaning fluid solution.

Figure 4:
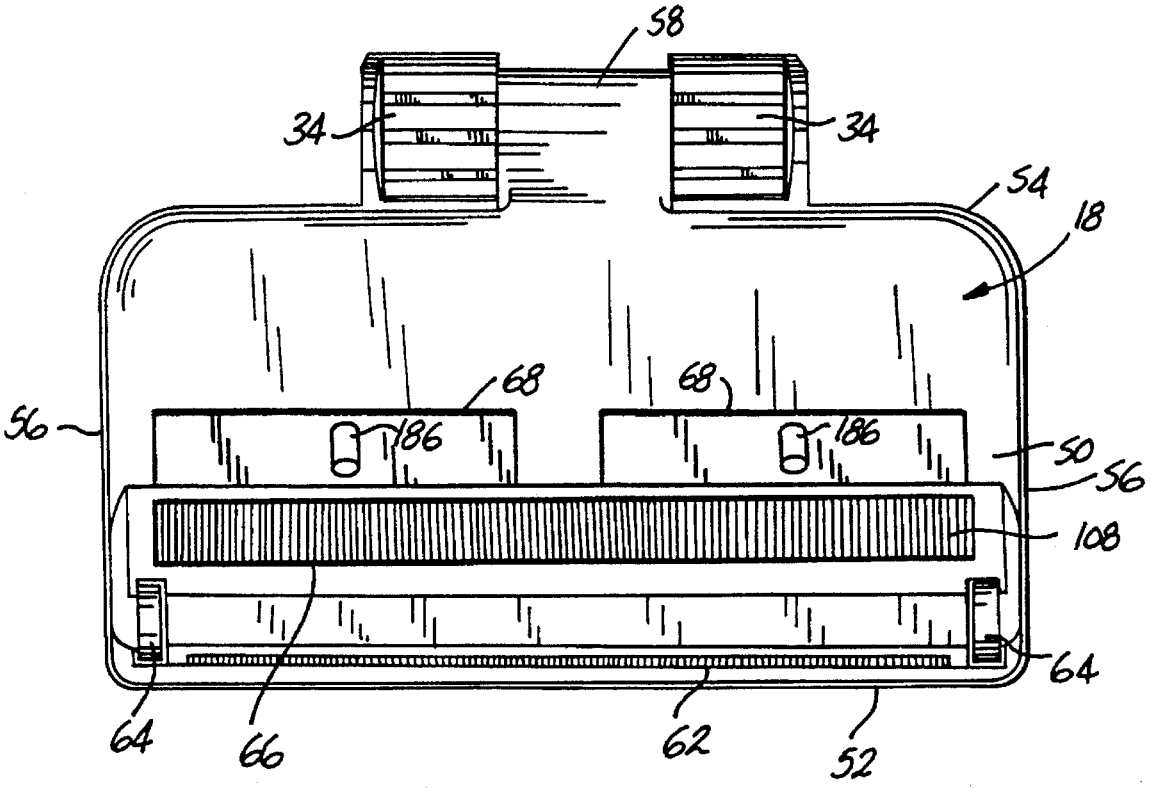
FIG. 4 is a bottom plan view of the multi-use power foot shown in FIG. 2 and 3.
Figure 5:
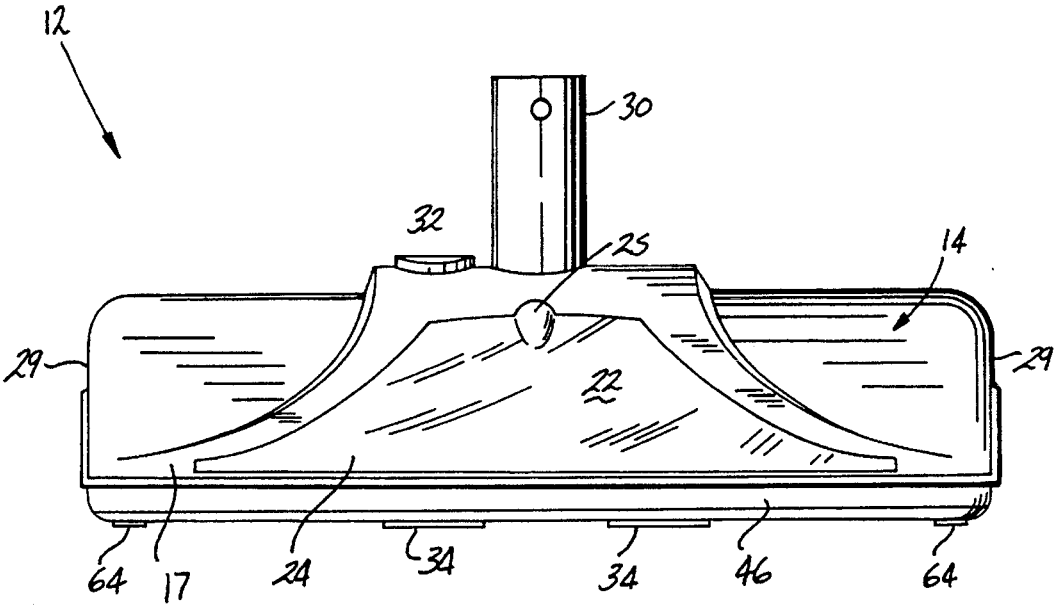
FIG. 5 is a front elevational view of the multi-use power foot shown in FIGS. 2–4.
Figure 6:
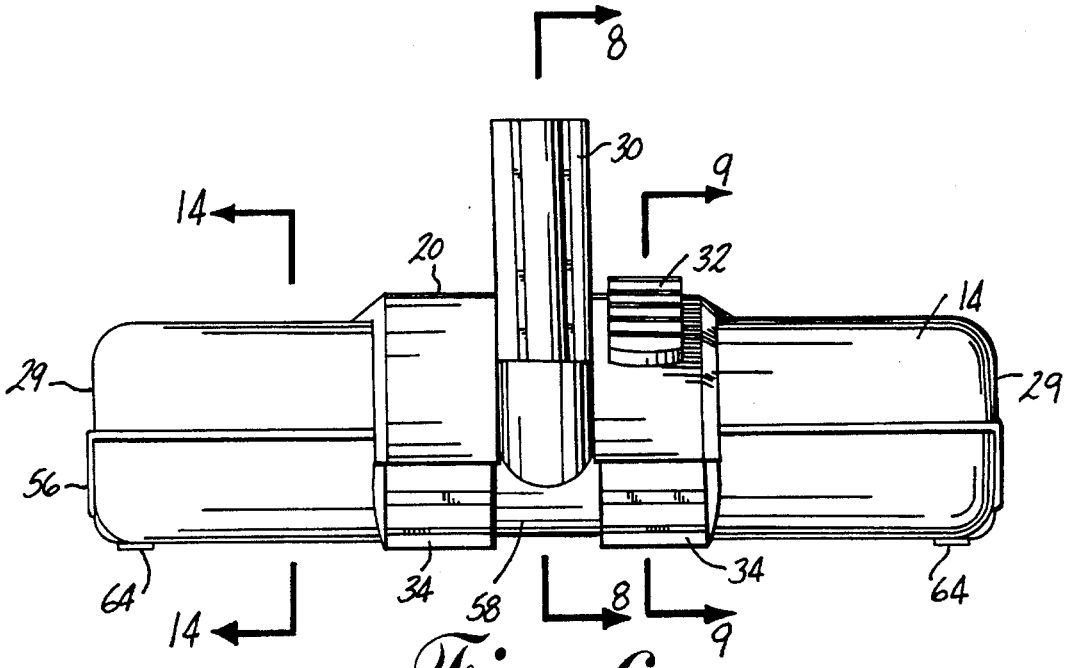
FIG. 6 is a rear elevational view of a multi-use power foot shown in FIGS. 2–5.
Figure 14:
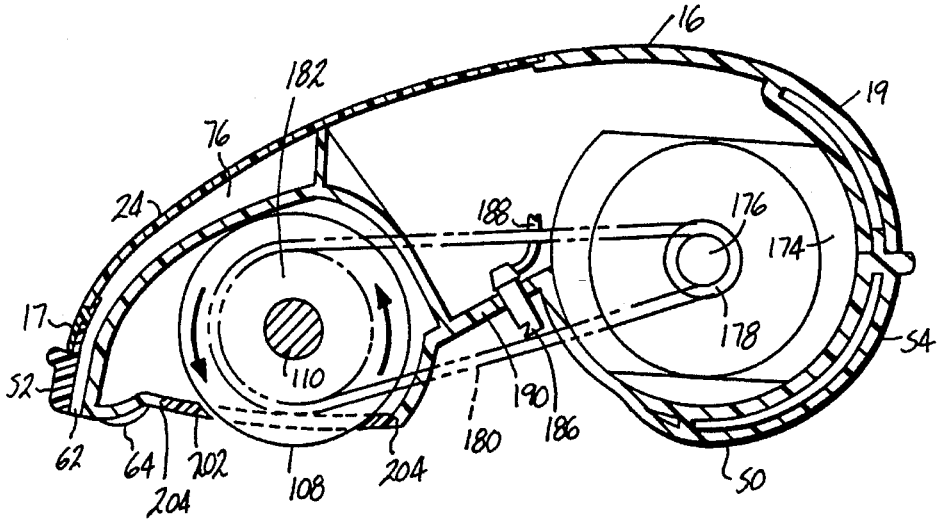
FIG. 14 is a sectional view taken along lines 14—14 of FIG. 6 showing the brush motor and fluid spray nozzle.

As seen in FIGS. 4 and 14, a pair of nozzles 186 project downwardly into the spray opening 68 in the bottom wall 50 of the lower housing member 18. These nozzles 186 are adapted to spray a cleaning solution in a wide pattern onto the surface to be cleaned immediately adjacent to the rotating brush 108. The nozzles 186 are connected through a tube 188 to the fluid conduit 140. The fluid conduit 140, in turn, is connected to the pump and solution tank through the conventional trigger 21 which controls the fluid dispensed through the spray nozzles 186.

The sectional views of the power foot 12 as seen in FIGS. 8 and 9 show the power foot in the dry vacuum mode. In this mode, the diverter valve switch 32 is located to the rear of the housing 14 and therefore the switch arm 166 engages the first electrical contacts 168. In operation as a dry vacuum, a source of suction is applied to the outlet 22 by the multi-use cleaning machine (not shown) while the brush 108 rotates to agitate the surface being cleaned. Air and entrapped dirt are drawn into the housing 14 through the brush opening 66 of the brush chamber. The air and entrapped dirt pass through the dry suction opening 88, through the wide mouth opening 106 and into the tubular suction channel 102 to the suction conduit 38. From the suction conduit 38, the air and entrapped dirt pass through the wand 13 to a dirt receptacle (not shown) within the multi-use machine 10.

Air flow through the water suction channel 76 to the tubular suction channel 102 is prevented by the diverter valve wall 112 which is positioned within the opening 72 between the edge 74 of the front internal wall 72 and the transition wall portion 84. The arcuate wall 114 creates a substantially air-tight fit, thereby preventing air flow through the water suction channel 76. Therefore, all of the suction power of the multi-use machine is directed to the dry vacuum nozzle found at the brush opening 66.

Figure 10:
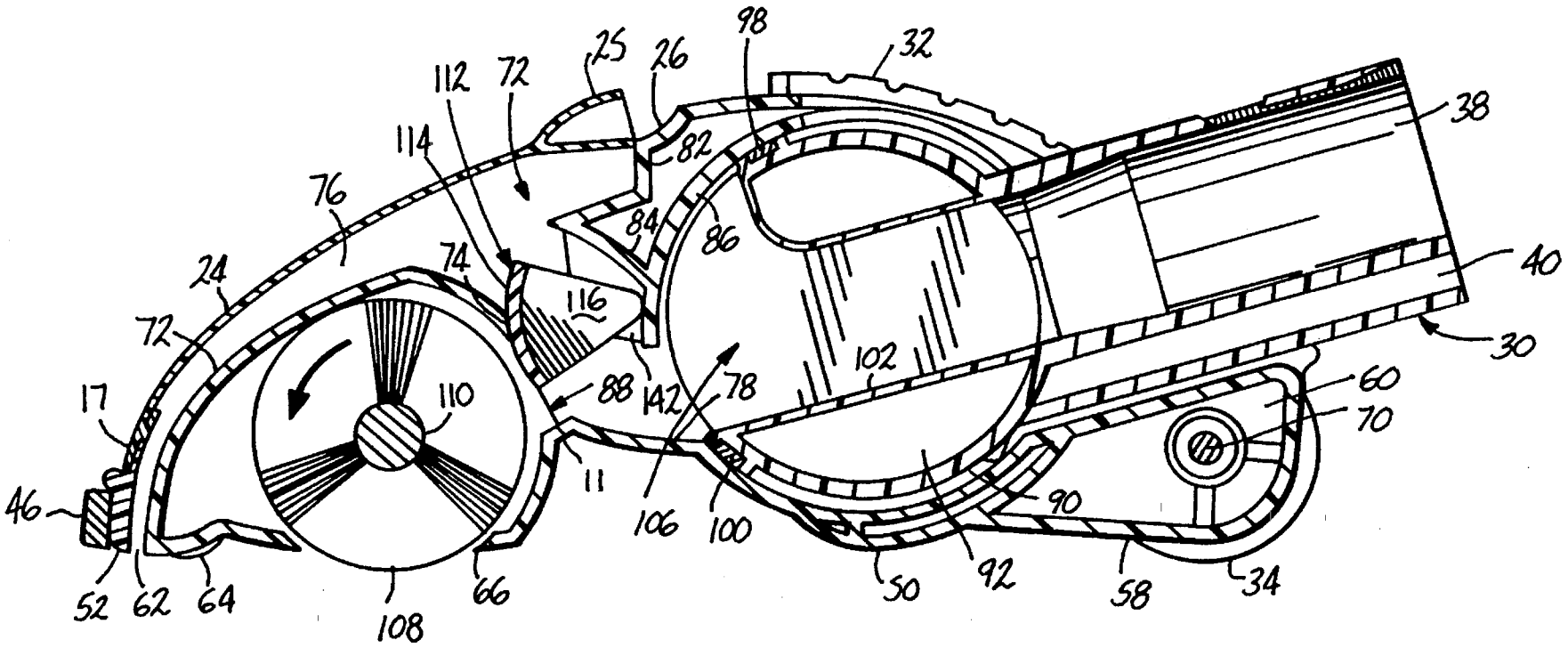
FIG. 10 is a sectional view of the power foot like FIG. 8 showing the diverter valve member in the off position and showing the outlet tube in a reclining position.
Figure 11:
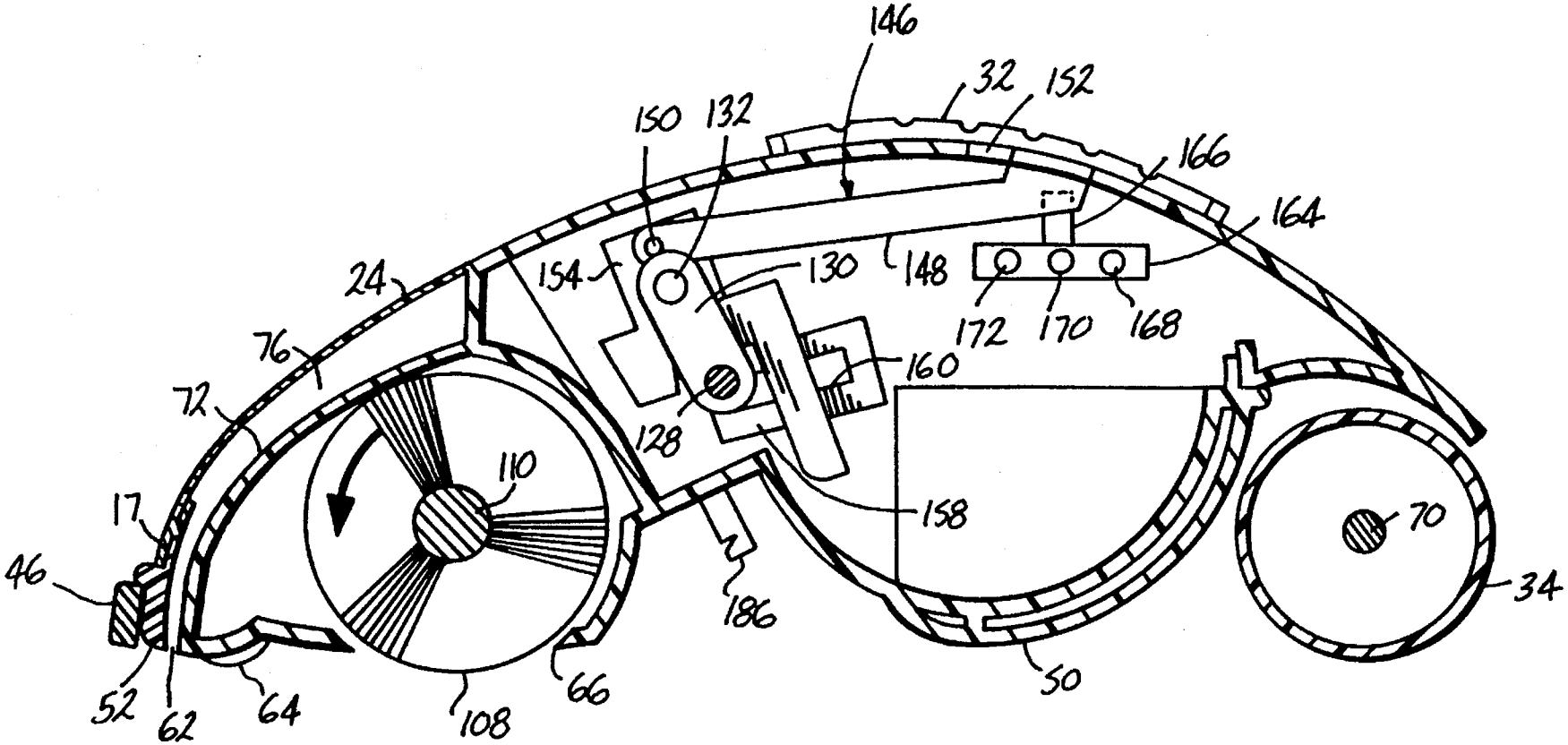
FIG. 11 is a sectional view of the power foot like FIG. 9 showing the actuator and switch in the off position.

FIGS. 10 and 11 are sectional views of the power foot in the off position. In this mode, the diverter valve switch 32 is located at a center position where the switch arm 166 of the three position electrical switch 164 is positioned at the second electrical contacts 172 which are open. In this configuration, no electrical current is supplied to the brush motor 174 and the motor is not engaged. The user slides the diverter valve switch 32 forward relative to the housing 14 to move from the dry vacuum mode to the off position. The movement of the diverter valve switch 32 to the off position rotates the diverter valve 112 to a neutral position illustrated in FIG. 9. As seen in FIG. 10, the arcuate wall 114 of the diverter valve 112 is partially received in both the opening to the water suction channel 76 and the dry vacuum opening 88.

Figure 13:
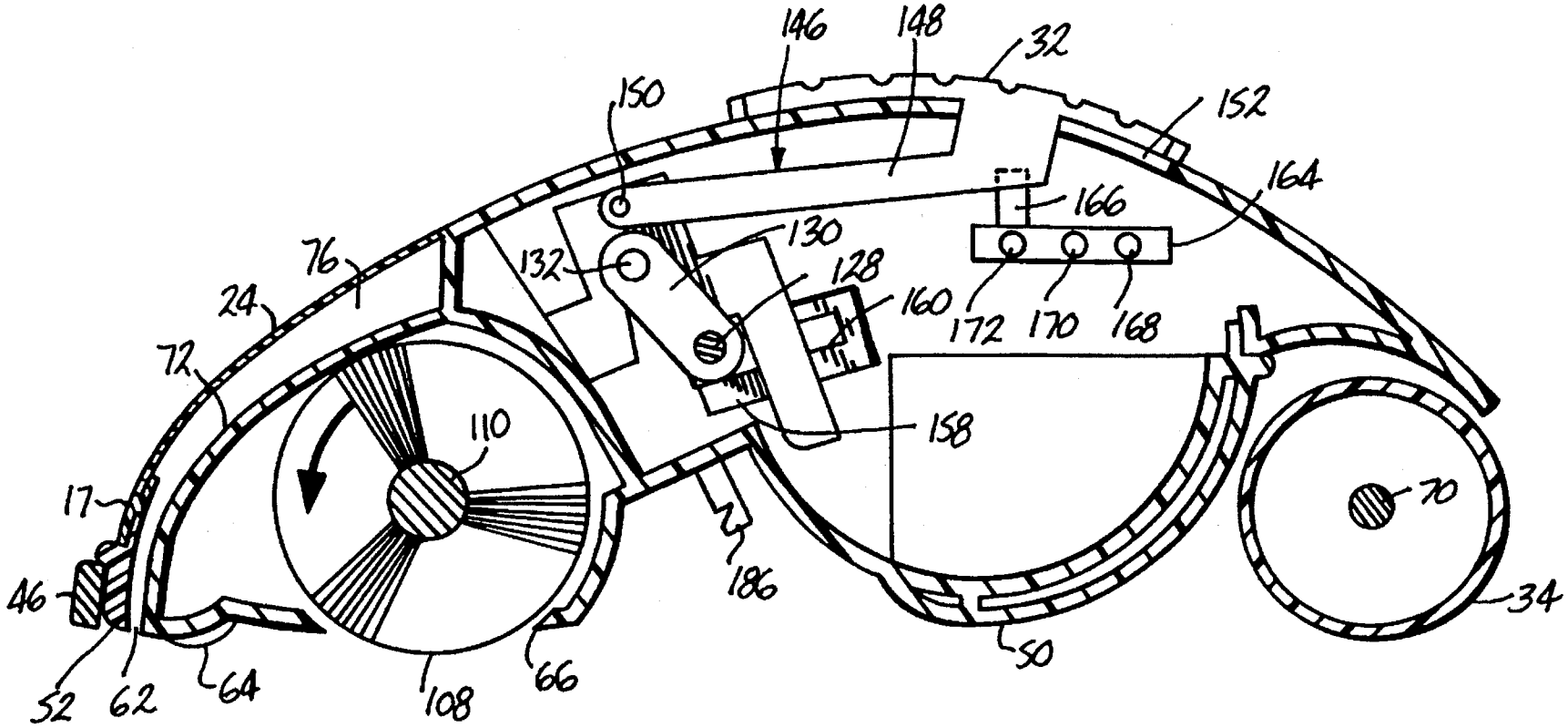
FIG. 13 is a sectional view of the power foot like FIG. 9 but showing the actuator and switch in the water extraction position.

When the user desires to switch the machine from the off position to the water extraction mode, the user slides the diverter valve switch 32 forward relative to the housing 14 to the position shown in FIG. 13. This movement moves the actuator arm 148 to rotate the diverter valve 46 about its axis of rotation 137 until the wall 114 is seated in the dry vacuum opening 88 between the edge 74 and the central internal wall 78. In this configuration, as depicted in FIGS. 12 and 13, the air flow, water and entrapped dirt are drawn into the housing 14 through the wet vacuum opening 62. The water, air, and dirt pass through the water suction channel 76, through the diverter valve 112 to the tubular suction channel 102. The arcuate wall 114 of the diverter valve 112 closes the dry vacuum opening 88 substantially air-tight and prevents air flow therethrough, thereby focusing the suction supplied by the multi-use machine to the water suction channel 76.

The position of the valve actuator 146 in the water extraction position is seen in FIG. 13. In moving from either the off position or the dry vacuum mode to the water extraction mode, the user slides the diverter valve switch 32 forward along the raised central channel 20. The first end of the actuator arm 148 moves forward within the opening 152. The forward movement of the actuator arm 148 pushes the sliding member 154 forward within the housing and moves the switch arm 166 to the third set of electrical contacts 172 of the three position switch 164. The forward movement of the sliding member 154 causes the linking arm 130 and diverter valve member 112 to pivot about the axis of rotation 137.

Although the preferred embodiment of the power foot 12 permits the diverter valve switch 32 to be located in the dry vacuum, water extraction and off positions, one embodiment of the power foot according to the invention eliminates the off position. Namely, the diverter valve 112 is received in only one of two positions, either the dry vacuum position, as seen in FIGS. 8 and 9, or the water extraction positions, as seen in FIGS. 12 and 13. The control for turning the power on and off is mounted in the housing of the multi-use machine, and not in the power foot.

As seen in FIG. 14, the fluid spray nozzles 186 extend downwardly through the central internal wall 78 into a fluid spray nozzle recess 190. Fluid is supplied to the nozzle 186 by conduit 188. In the preferred embodiment, a pair of fluid spray nozzles 186 are mounted in the wall 78.

FIG. 14 also depicts, in phantom lines, the belt 180 interconnecting the brush motor 174 and the rotating brush 108. The belt 180 is received around the pulley 178 in the drive shaft 176 of the brush motor 174 and around a pulley 184 mounted to one end of the brush axle 110.

FIG. 14 also depicts a further possible modification to the power foot according to the invention. As seen in FIG. 14, a sole plate 202 can be snap-fit to the bottom of the housing 14. The sole plate is attached to the housing by a complementary tongue and groove connection 204 formed at selected positions along the front edge and rear edge of the sole plate 202. In this embodiment, the sole plate 202 extends the entire width of the lower housing member 18 of the housing 14 and the brush opening 66 of the lower housing member 18 is formed in the sole plate 202. As in the first embodiment, the bristles of the brush 108 extend through the brush opening 66 to engage the surface to be cleaned. In light of the snap-fit connection of the sole plate 202 to the lower housing member 18, the sole plate 202 can be easily removed to allow the user to access the dry suction channel or brush 108 for servicing or cleaning.

As seen in FIGS. 8, 10 and 12, the tubular outlet 30 is pivotally mounted between the upper housing member 16 and the lower housing member 18. The tubular outlet can be positioned in an upright position shown in FIG. 8, a reclining position shown in FIGS. 10 and 12 and any position between these two extremes. The cylindrical cover end 90 is received within the cylindrical cavity formed by arcuate walls 80 and 86. As seen in FIG. 12, the tubular outlet 30 can pivot downwardly to a reclining position at which it extends to the rear of the housing 14 at an angle of approximately 20° from the horizontal surface to be cleaned. In the reclining position, the power foot 12 can easily be pushed underneath low-profile furniture such as beds, dressers, coffee tables, etc.

Figure 15:
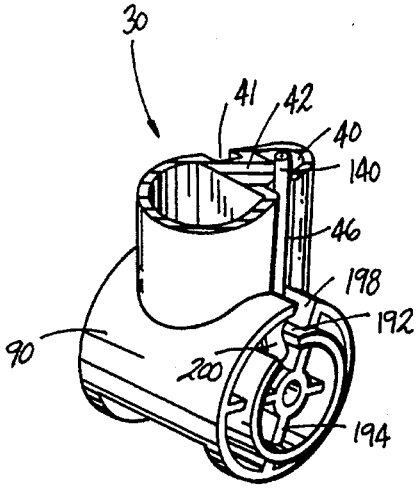
FIG. 15 is a perspective view of the outlet and the pivotable base of the outlet.
Figure 16:
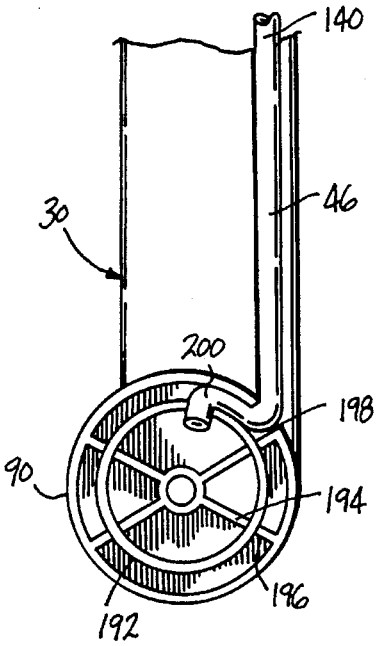
FIG. 16 is a side elevational view of the outlet and pivotable base of the outlet.

As seen in FIGS. 15 and 16, the cylindrical cover end 90 of the tubular outlet 30 has a cylindrical tubular portion 192 which extends outwardly a short distance from the outer body of the lower end 90. While only the right side of the lower end is shown in FIGS. 15 and 16, the left side view is a mirror image thereof.

The cylindrical tubular portion 192 of the outlet is formed concentric with and connected through radial webs 196 to the outer body of the cylindrical lower end 90. The cylindrical tubular portion 192 is received within a complementary surface to pivotably mount the lower end 90 in the upper housing member 16 on the interior of the upper housing depending walls 36. The body of the lower end 90 and the cylindrical tubular portions 92 each have a slit 198, 200, respectively, formed on each side of the lower portion 90 to receive one of the fluid conduit 140 or the electrical cord 138. The fluid conduit 140 and electrical cord 138 extend down the length of the channels 46 and 44, respectively. The fluid conduit 140 and electrical cord 138 exit the channels 46, 44 and pass through the slits 198, 200 and into the upper housing member 16. The cooperating channels 46, 44 and slits 198, 200 effectively guide the fluid conduit 140 and electrical cord 138 into the housing 14 while permitting free pivotable movement of the tubular outlet without interference by or damage to the fluid conduit 140 and electrical cord 138.

As seen in FIGS. 8 and 10, the wide mouth opening 106 of the tubular suction channel 102 is significantly larger than the diameter of the outlet conduit suction channel 102. The relatively large opening 106 allows unrestricted air flow from the dry vacuum opening 88 and the water suction channel 76 in any rotational position of the tubular outlet 30. The sealing members 98, 100 engage the arcuate walls 86, 80, respectively, to maintain the airtight integrity of the interconnection between the lower end 90 and the suction portions of the housing 14. The sealing members preferably comprise a soft, elastomeric material.

FIGS. 17–22 depict a second embodiment of the ground engaging power foot according to the invention. Identical numerals used above in describing the first embodiment will be repeated here for identical parts.

Figure 17:
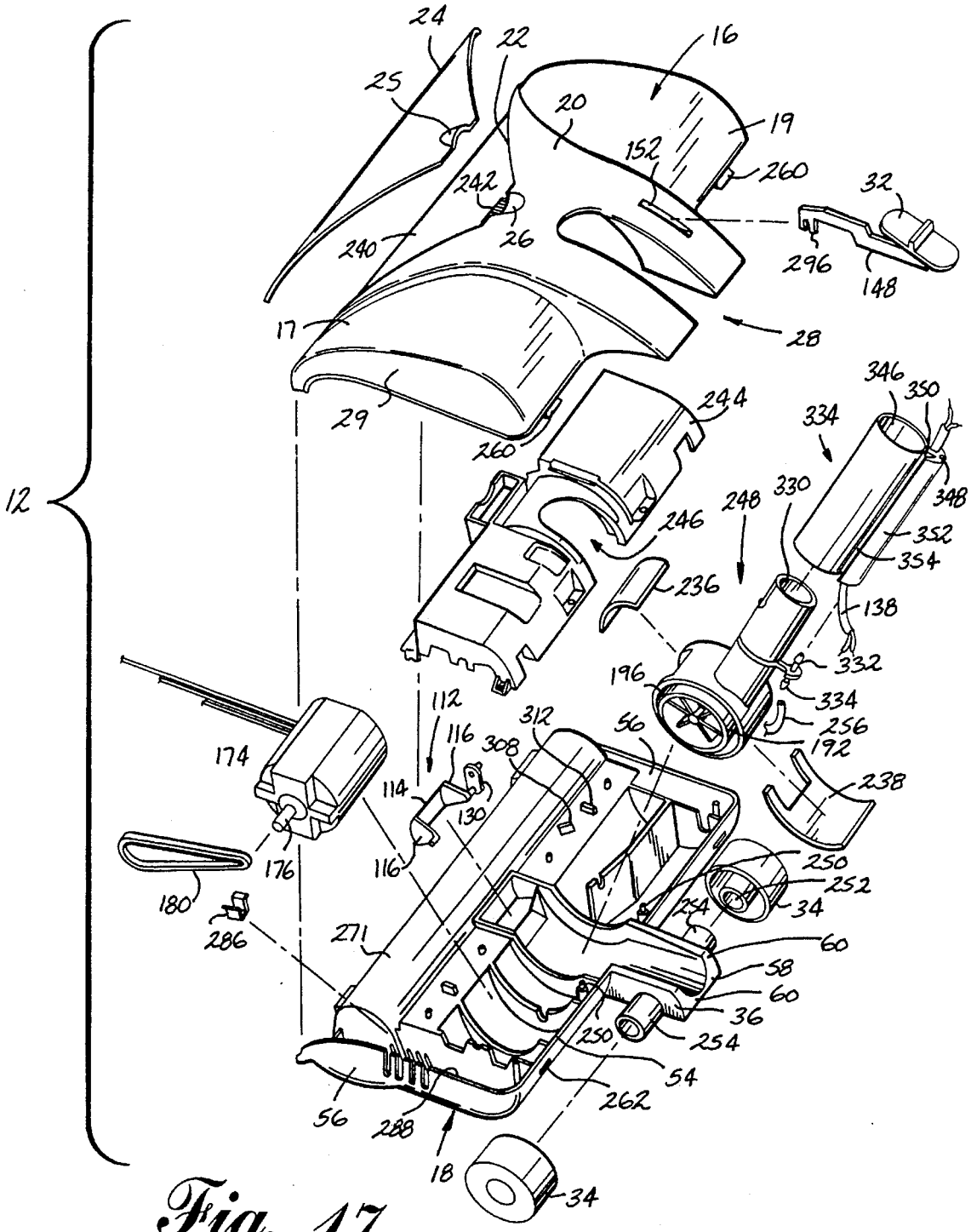
FIG. 17 is an exploded view of a second embodiment of the power foot according to the invention.
Figure 18:
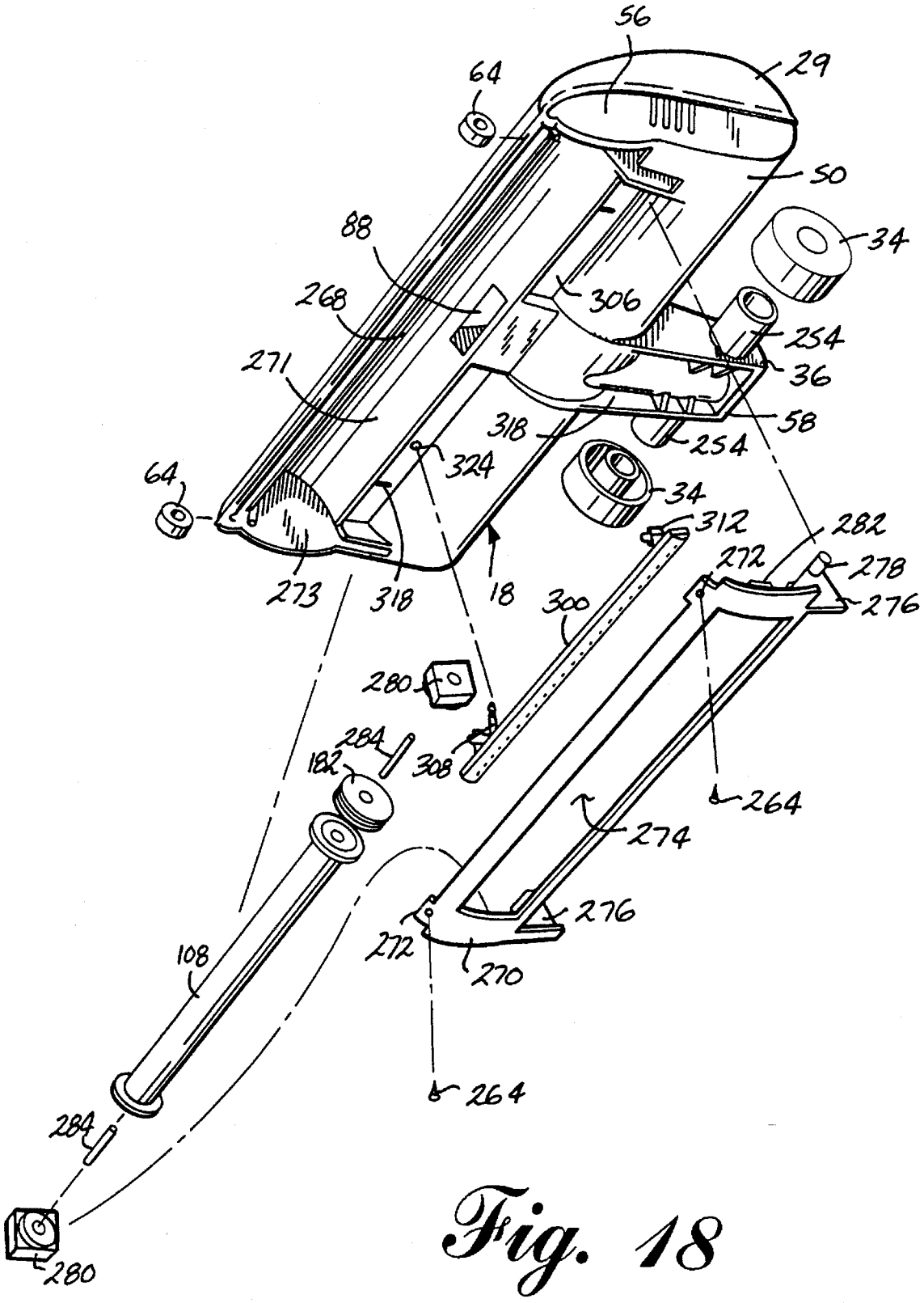
FIG. 18 is an exploded view of the lower portion of the power foot according to the invention.
Figure 19:
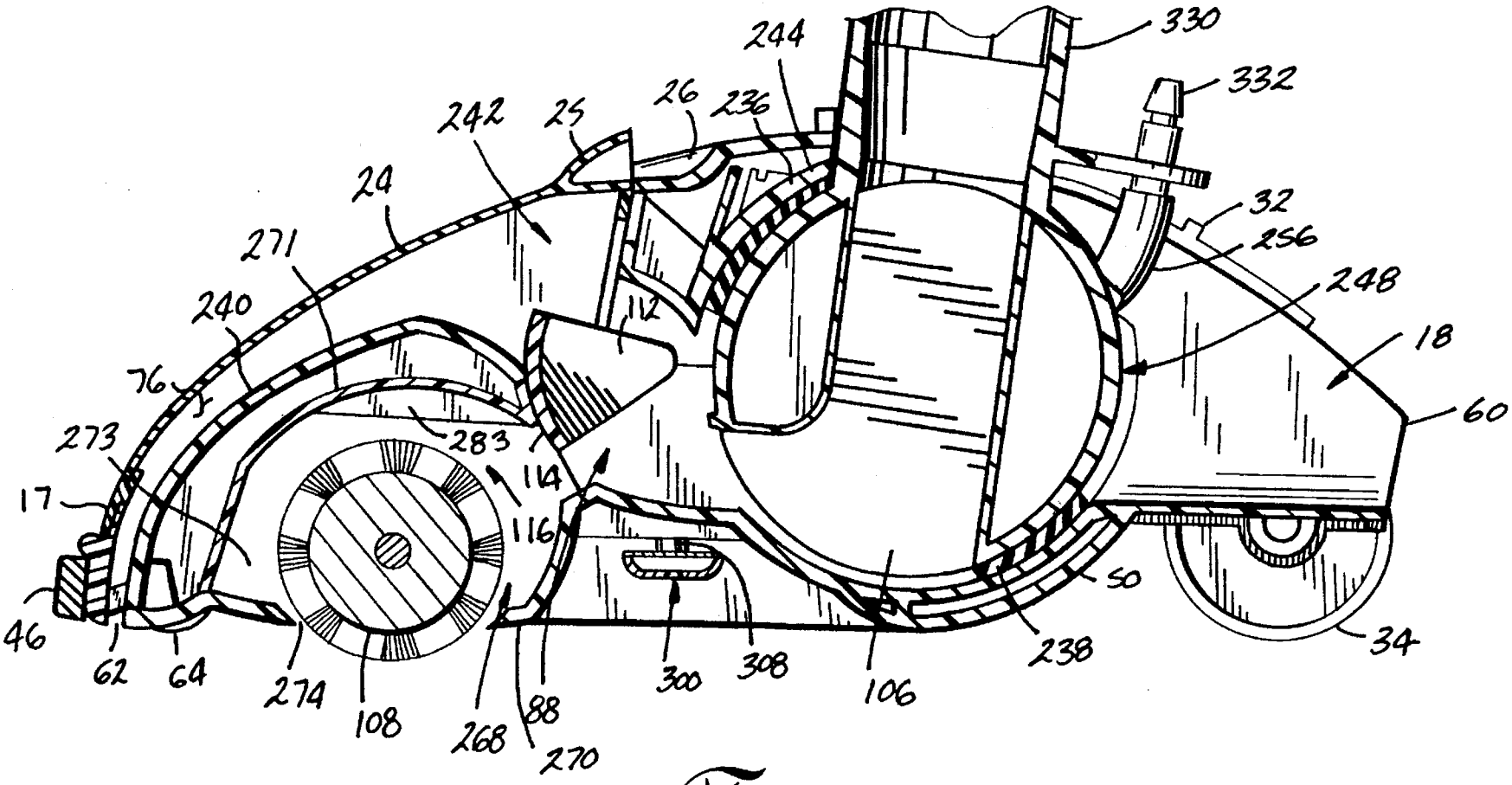
FIG. 19 is a cross sectional view of the second embodiment of the power foot according to the invention similar to FIG. 8 showing the diverter valve member in the dry vacuum position.

As seen in FIGS. 17-19, the upper housing member 16 is substantially similar to that of the first embodiment. Namely, the upper housing has a front edge 17, a rear edge 19, a raised central portion 20 extending between the front and rear edges, a U-shaped recess 28 formed at the rear portion of the raised central channel 20 and a truncated triangular shaped opening 22 forming a portion of the water suction channel 76. In the second embodiment, the water suction channel 76 is defined by the lens 24 and a front internal wall 240 integrally formed into the upper housing member 16. A water suction channel outlet 242 is mounted at the rear portion of the water suction channel 76. The diverter valve member 112 can be manipulated to at least partially block the water suction channel outlet 76 from the source of vacuum suction.

In the second embodiment, an intermediate cowl member 244 is mounted between the upper housing member 16 and lower housing member 18. The cowl member 244 has a U-shaped opening 246 formed therein to accommodate the rotatively mounted pivot tee 248. The cowl member 244 is securely fastened to the lower housing member 18 by conventional fasteners 250.

As in the first embodiment, rear wheels 34 are rotatively mounted to the depending walls 36 of the rearward extension 58. In the second embodiment, the rear wheels 34 have integrally molded axles 252 which are received inside tubular axle supports 254 extending outwardly from the depending walls 36. The tubular axle supports 254 are hollow and the inside diameter of the support 254 closely approximates the outside diameter of the axles 252.

The upper housing member 16 is selectively mounted to the lower housing member 18 by a pair of retaining tabs 260 mounted to the rear edge 19 of the upper housing member 16 and a pair of complementary slots 262 formed in the back wall 54 of the lower housing member 18. A pair of conventional fasteners or screws 264 (FIG. 20) extend through the lower housing member 18 and engage a pair of threaded bosses 266 (FIG. 20) formed in the upper housing member 16. In this embodiment, the user can gain access to the interior of the power foot 12 by removing the mounting screws 264 from the threaded bosses 266 and pivoting the front of the upper housing member 16 up relative to the lower housing 14 to disengage the arcuate retaining tabs 260 from the retaining slots 262, thereby disengaging the upper and lower housing members.

Figure 20:
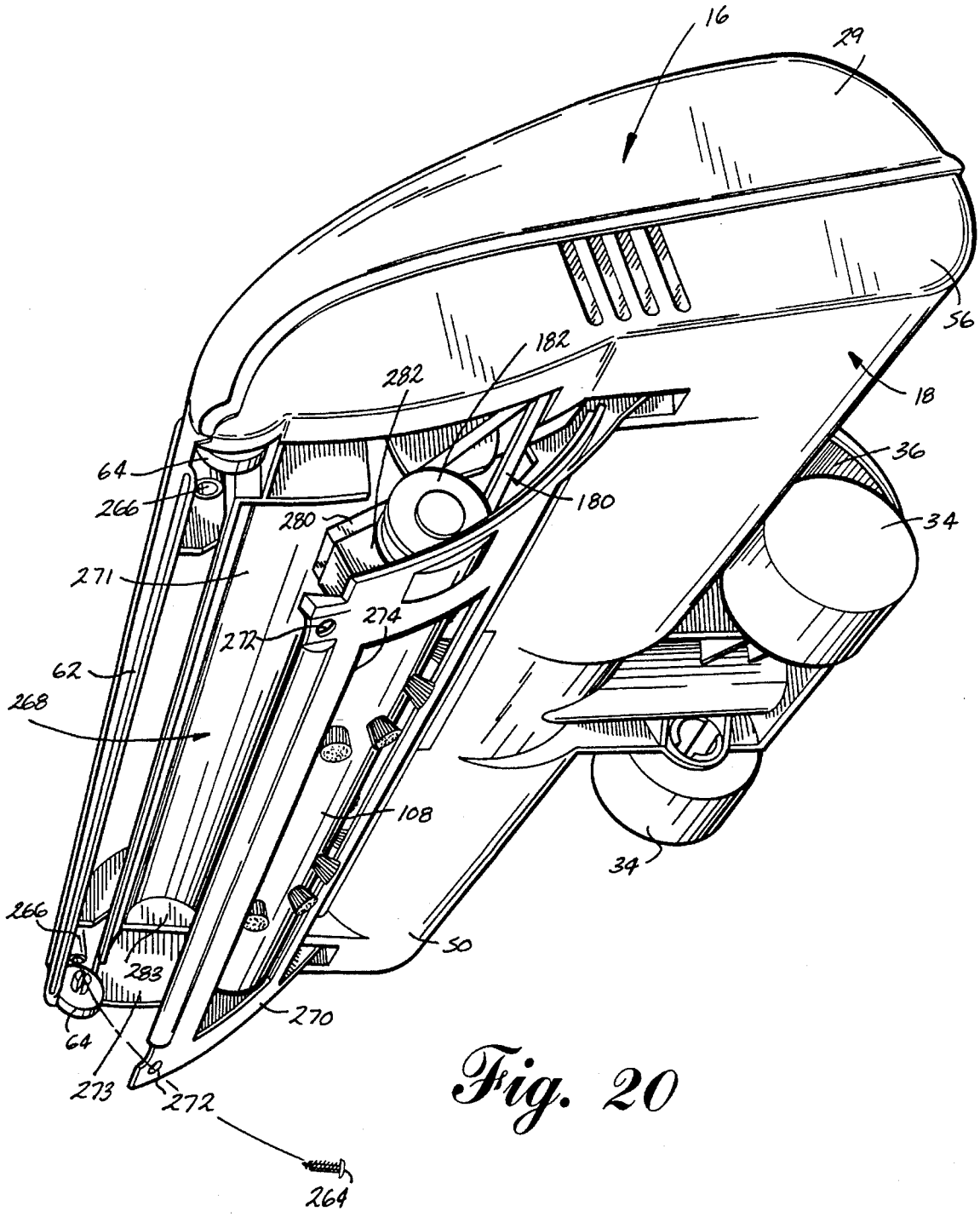
FIG. 20 is a lower perspective view of the power foot according to the invention with the sole plate pivoted to the open position.

As seen in FIGS. 18 and 20, the mounting screws 264 also serve the function of securely mounting a pivotally mounted sole plate 270 in the operating position. The mounting screws 264 pass through suitable apertures 272 in the sole plate 270 to securely mount the leading edge of the sole plate 270 to the upper housing member 16. The sole plate 270 further comprises a brush opening 274, a pair of upwardly extending side walls 276 and a pair of outwardly extending pivot pins 278 integrally molded to the side walls 276. The pivot pins 278 are received in complementary apertures (not shown) formed in the lower housing member 18.

The brush 108 is securely mounted to the sole plate 270 by a pair of bearing members 280 which are securely mounted to bearing member supports 282 formed on opposite sides of the brush opening 274. The bearing members 280 are square and are received in complementary square bearing support members 282. The bearing members 280 are captured between the bearing member supports 282 and an upper bearing surface 283 formed at the ends of the arcuate top wall 271 when the sole plate 270 is pivoted upwardly into the operating position.

The bearing members 280 rotatably mount one end of a support axle 284, the other end being securely received in the end of the brush 108. As in the first embodiment, the drive belt 180 extends around the pulley 182 of the brush 108 and the pulley 178 of the motor drive shaft 176 to convey the force of rotation from the motor drive shaft 176 to the brush 108. The second embodiment also includes a belt guide 286 which is securely mounted in the belt recess 288 of the lower housing member 18. The belt guide 286 preferably comprises a U-shaped piece of metal which helps maintain the alignment of the belt 180 within the belt recess 288.

A dry vacuum nozzle is mounted in the lower housing member 18 and is defined by the sole plate 270, an arcuate top wall 271 and opposed side walls 273. The arcuate top wall 271 is adapted to receive the brush 108 when the sole plate 270 is pivoted upwardly into the operating position. As seen in FIG. 20, the sole plate 270 is pivotally mounted to the lower housing member 18 such that the user can quickly access the dry vacuum nozzle 268. As in the first embodiment, the dry vacuum nozzle 268 terminates in a dry vacuum opening 88.

The diverter valve member of the first embodiment effectively seals the water suction channel 76 from the source of suction when the machine is in the dry vacuum mode and seals the dry suction opening 88 from the source of vacuum when the machine is in the water extraction mode. The diverter valve mechanism of the second embodiment is similar to that of the first in that, during water extraction, the diverter valve 112 effectively seals the dry vacuum opening outlet from the source of suction such that all of the suction power is directed to the wet vacuum opening 62. However, in the second embodiment, the amount of rotation of the diverter valve 112 is limited in moving from the water extraction mode to the dry vacuum mode such that neither the water suction channel 76 nor the dry vacuum nozzle 268 are completely sealed or blocked from the source of vacuum. Rather, both of the nozzles are partially blocked by the diverter valve 112 such that the source of vacuum is applied to both the wet vacuum opening 62 and the dry vacuum opening 88. The amount of rotation of the diverter valve 112 can be altered by varying the size of the actuator arm opening 152 in the raised central portion 20 of the upper housing member 16.

Still another difference between the first and second embodiments lies in the mounting of the actuator arm 148 to the diverter valve 112. In the second embodiment, the actuator arm 148 terminates in a U-shaped mounting slot 296. The mounting slot receives the shaft 132 (FIG. 7) of the diverter valve 112 when the upper housing member 16 is mounted to the lower housing member 18. When the upper housing member 16 is removed from the lower housing member 18, the shaft 132 (FIG. 7) of the diverter valve 112 is removed from the mounting slot 296 of the actuator arm 148.

Figure 21:
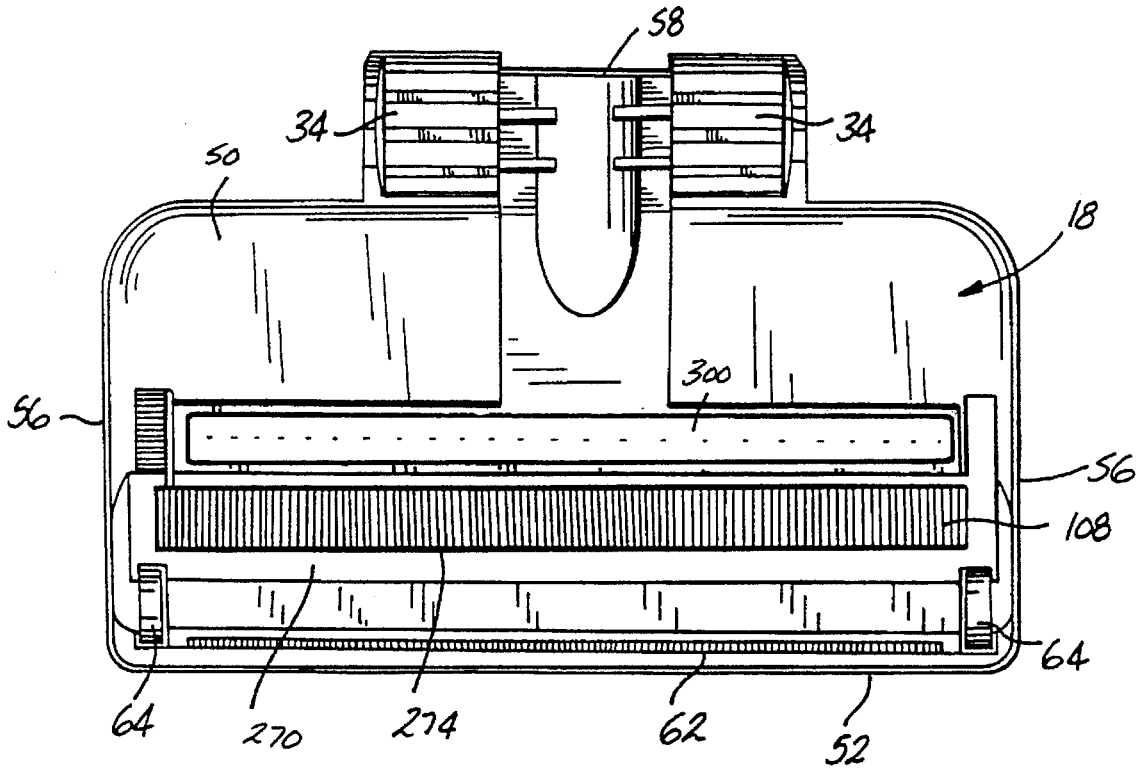
FIG. 21 is a bottom plan view of the second embodiment of the power foot according to the invention.
Figure 22:
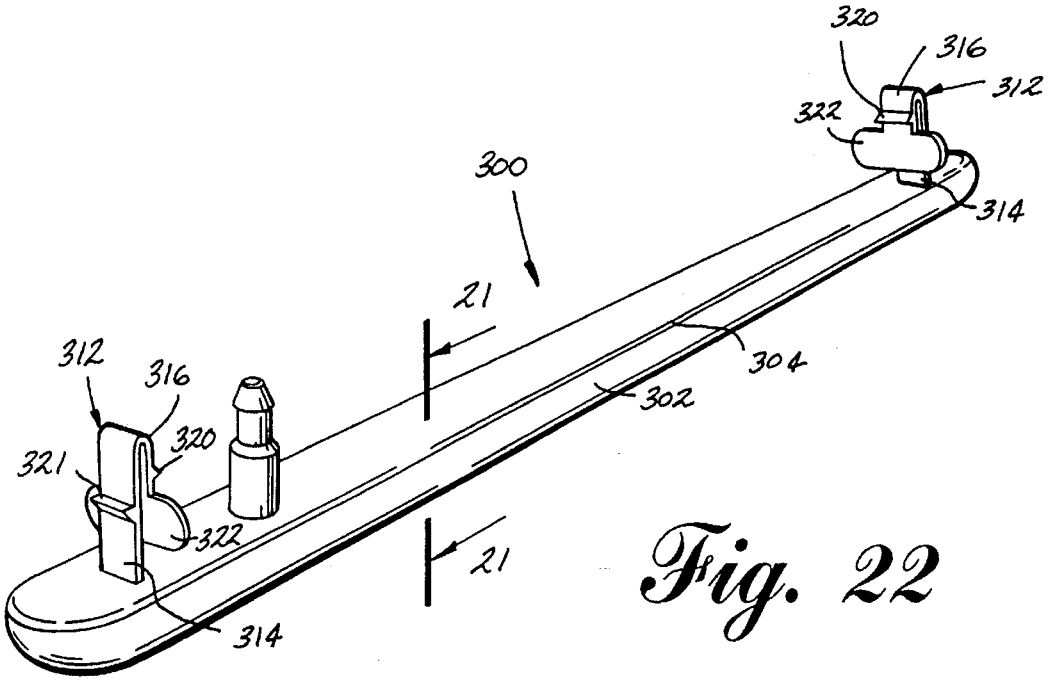
FIG. 22 is a perspective view of the spray bar of the second embodiment of the power foot according to the invention.
Figure 23:
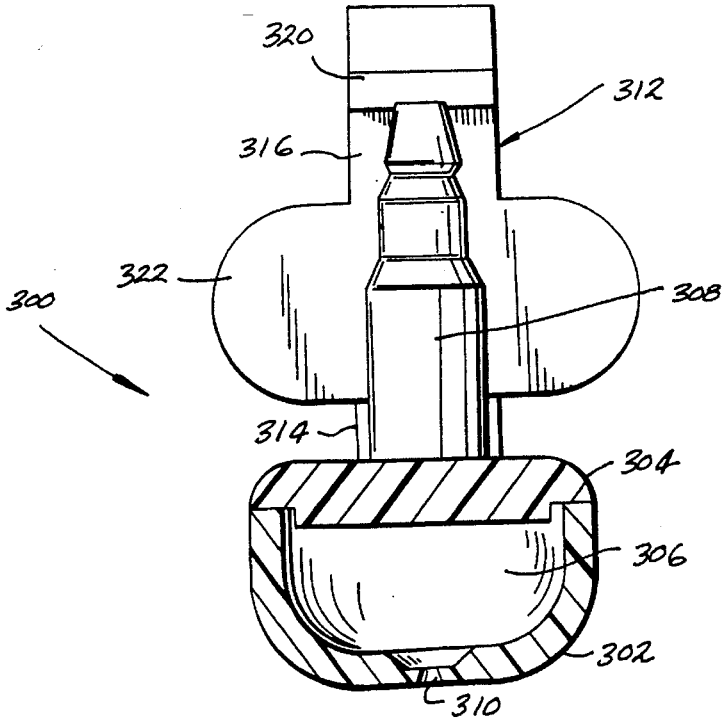
FIG. 23 is a cross sectional view of the spray bar assembly taken along lines 23—23 of FIG. 22.

The second embodiment also comprises a different means for conveying the cleaning solution from the power foot 12 to the surface to be cleaned. In this embodiment, a laterally extending spray bar 300 is mounted to the lower housing member 18. As seen in FIGS. 18, 22 and 23, the spray bar 300 comprises a U-shaped lower member 302 and a substantially planar upper member 304 wherein the upper and lower members define an internal cavity 306 therebetween. The upper and lower members 302, 304 are securely mounted to one another by heat staking or by a conventional adhesive. A solution inlet 308 is formed in the upper member and is adapted to receive the terminal end of the water solution conduit 256. The water cleaning solution enters the spray bar 300 through the solution inlet 308 and is distributed uniformly across the surface to be cleaned through a plurality of nozzle openings 310 formed in the lower member 302. Preferably, the nozzle openings 310 comprise a truncated cone. The cleaning solution enters the spray bar cavity 306 under pressure and the truncated cone shape of the nozzle openings 310 causes the pressurized solution to exit the spray bar 300 in a spray pattern. As seen in FIG. 21, the spray bar 300 spans substantially the entire width of the power foot resulting in uniform application of the cleaning solution to the surface to be cleaned.

The spray bar 300 is selectively mounted to the lower housing member 18 by a pair of upwardly extending mounting members 312 formed adjacent each end of the spray bar 300. The mounting members 312 comprise an upwardly extending first leg 314 and a downwardly extending second leg 316. The mounting members 312 are preferably formed of a resilient material such that the second leg 316 can be easily deformed with respect to the first leg 314. The mounting member 312 is received in a complementary mounting member aperture 318 formed in the lower housing member 18. The mounting members 312 are inserted into the mounting member apertures 318 such that the second leg 316 deforms with respect to the first leg until an outwardly extending upper locking flange 320 passes through the aperture 318.

As the mounting members 312 are inserted further into the mounting member apertures 318, a lower locking flange 321 will abut the underside of the lower housing member 18 and prevent continued insertion of the mounting member 312 into the aperture 318. In this position, the resilient second leg is deflected outwardly such that the upper locking flange 320 engages the top surface of the bottom member. The cooperation of the upper locking flanges 320 and lower locking flanges 321 of the two mounting members 312 securely mounts the spray bar in position.

Preferably, a grip tab 322 is formed at the terminal end of the second leg 316 of the mounting member 312. The spray bar 300 can be removed from the lower housing member 18 by squeezing the grip tab 322 thereby deflecting the second leg 316 toward the first leg 314 such that the upper locking flange 320 no longer engages the upper surface of the lower housing member 18. Preferably, a solution inlet aperture 324 is formed in the lower housing member 18 such that the solution inlet 308 extends upwardly into the power foot 12 when the spray bar 300 is mounted to the lower housing member 18.

The pivot tee 248 of the second embodiment also differs somewhat from that of the first embodiment. In this embodiment, the pivot tee 248 is adapted to cooperate with an integrally molded wand 344. The wand 344 has an integrally molded vacuum conduit 346, an integrally molded solution conduit 348 and a longitudinally extending rib 350 interconnecting the two conduits 346, 348. A flange 352 extends outwardly from the solution conduit 348 and defines a first groove 354 defined by the flange, the solution conduit 348 and the rib 350. The groove 354 is adapted to receive a power cord 138 extending from a suitable power source to the brush motor 174.

The pivot tee 248 comprises an upwardly extending outlet conduit 330 and a pair of male connectors 332, 334 securely mounted thereto. The first male connector 332 extends upwardly and is adapted to be telescopically received within the solution conduit 348 of the wand. The second male connector 334 extends downwardly from the first male connector 332 and is adapted to receive one end of the water solution conduit 256. Solution flows from the clean solution reservoir under pressure through the solution conduit 348 of the wand 344, through the first and second male connectors 332, 334, into the water solution conduit 256 of the pivot tee 248 and ultimately to the spray bar 300.

The water, dirt, dust and other debris entrapped in the vacuum air flows from the water suction channel 76 and/or the dry vacuum nozzle 268, through the diverter valve member 112 into the pivot tee 248 and ultimately out the outlet conduit 330 into the vacuum conduit 346 of the wand. As in the first embodiment, the pivot tee 248 is rotatively mounted in the power foot 12. In this embodiment, upper and lower bearing members 236, 238, are adapted to receive the circular housing of the pivot tee 248 in the assembled power foot 12.

The combination vacuum cleaner and water extractor power foot according to the invention provides a significant improvement in floor care devices. The rotating brush agitates the carpet or hard floor in both the dry vacuum and the water extraction processes. The power foot according to the invention accomplishes this function without requiring the assembly of multiple pieces or additional equipment to the power foot. With the simple movement of a mechanical/electrical switch, the user can quickly and efficiently change from the dry vacuum process to the water extraction process. Now, with a single power foot mounted to a multi-use machine, the user can reap the benefits of an agitation member for both the dry vacuum and water extraction processes.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A combination vacuum cleaner and liquid extractor foot for cleaning a surface comprising:

a housing having a front edge, a rear edge opposite the front edge, and a bottom surface extending between the front and rear edges;

at least one suction opening formed in the housing bottom surface;

a vacuum source;

an outlet suction conduit connected to the housing and connected to the vacuum source, the outlet suction conduit comprising:

a tubular body rotatably mounted in the housing;

an inlet opening formed in the tubular body;

an outlet opening formed in the tubular body; and a wand mounting member extending outwardly from the outlet opening, the wand mounting member having a first fluid conduit connected to the vacuum source and a second fluid conduit connected to a source of cleaning solution;

a connecting conduit mounted in the housing and fluidly interconnecting the at least one suction opening and the inlet opening of the outlet suction conduit;

wherein dirt and dust entrapped in a vacuum flow created by the vacuum source is conveyed from the connecting conduit, through the inlet opening into the tubular body of the outlet suction conduit, through the outlet opening of the tubular body and through the first fluid conduit of the wand mounting member to the vacuum source.

2. A combination vacuum cleaner and liquid extractor foot according to claim 1 and further comprising at least one spray nozzle for distributing cleaning fluid to the surface to be cleaned, the at least one spray nozzle being mounted in a recess in the bottom surface of the housing.

3. A combination vacuum cleaner and liquid extractor foot according to claim 1 wherein the outlet suction conduit is pivotably mounted to the housing.

4. A combination vacuum cleaner and liquid extractor foot according to claim 1 and further comprising a spray bar mounted to the bottom surface of the housing for distributing cleaning fluid to the surface to be cleaned.

5. A combination vacuum cleaner and liquid extractor foot according to claim 4 wherein the spray bar comprises a substantially hollow body, a solution inlet extending from an exterior surface of the spray bar to the hollow body and a plurality of solution outlets extending from the hollow body to the exterior surface, whereby cleaning solution under pressure is supplied to the hollow body through the inlet and the solution is distributed to the surface to be cleaned through the solution outlets.

6. A combination vacuum cleaner and liquid extractor foot according to claim 5 wherein the solution outlets comprise a truncated cone, whereby the truncated cone shape of the outlets produces a spray pattern for applying cleaning solution to the surface to be cleaned.

7. A combination vacuum cleaner and liquid extractor foot according to claim 5 wherein the housing comprises a top member and a bottom member, the top member being removably mounted to the bottom member such that the user can access the interior of the housing by removing the top member.

8. A combination vacuum cleaner and liquid extractor foot according to claim 7 and further comprising a cowl member mounted inside the housing between the top and bottom housing members, the outlet suction conduit being mounted intermediate the cowl member and the bottom housing member such that the top housing member can be removed without disturbing the outlet suction conduit.

9. A combination vacuum cleaner and liquid extractor foot according to claim 1 and further comprising forward and rear wheels mounted to the housing adjacent the front and rear edges, respectively, and wherein the outlet suction conduit is pivotally mounted to the housing between the forward and rear wheels so that an operator can apply downward force to the housing by applying downward force to the outlet conduit.

10. A combination vacuum cleaner and liquid extractor foot according to claim 7 and further comprising a sole plate pivotally mounted to the bottom surface of the housing and comprising at least an edge of the at least one suction opening wherein the sole plate can be pivoted downwardly to provide access to the interior of the at least one suction opening.

11. An improved combination vacuum cleaner and liquid extractor machine having a machine housing with a source of vacuum and a source of pressurized cleaning fluid mounted therein, a cleaning tool, a vacuum conduit extending between the vacuum source of the machine housing and the cleaning tool and a solution conduit extending between the machine housing and the cleaning tool, wherein the improvement comprises a combination vacuum cleaner and liquid extractor foot according to claim 1.

12. A combination vacuum cleaner and liquid extractor foot for cleaning a surface comprising:

a housing having a front edge, a rear edge opposite the front edge, a bottom surface extending between the front and rear edges, a top member and a bottom member, the top member being removably mounted to the bottom member such that the user can access the interior of the housing by removing the top member;

at least one suction opening formed in the housing bottom surface;

a vacuum source;

an outlet suction conduit connected to the housing and connected to the vacuum source;

a connecting conduit mounted in the housing and fluidly interconnecting the at least one suction opening and the outlet suction conduit; and a spray bar mounted to the bottom surface of the housing for distributing cleaning fluid to the surface to be cleaned, the spray bar having a substantially hollow body, a solution inlet extending from an exterior surface of the spray bar to the hollow body and a plurality of solution outlets extending from the hollow body to the exterior surface, whereby cleaning solution under pressure is supplied to the hollow body through the inlet and the solution is distributed to the surface to be cleaned through the solution outlets; and a cowl member mounted inside the housing between the housing top and bottom members and secured to the bottom member with the outlet suction conduit between the cowl member and the bottom member to retain the outlet suction conduit intermediate the cowl member and the bottom housing member when the top housing member is removed from the bottom member.

* * * * *

UNITED STATES PATENT AND TRADEMARK OFFICE

CERTIFICATE OF CORRECTION

PATENT NO. : 5,483,726
DATED : January 16, 1996
INVENTOR(S) : Michael Blase, et. al.

It is certified that error appears in the above-indentified patent and that said Letters Patent is hereby corrected as shown below:

Column 14, claim 10, line 49, change "7" to -- 1 --.

Signed and Sealed this

Thirtieth Day of July, 1996

*Attest:*

*Attesting Officer*

BRUCE LEHMAN

*Commissioner of Patents and Trademarks*